US006526947B2

(12) United States Patent
Shimada et al.

(10) Patent No.: US 6,526,947 B2
(45) Date of Patent: Mar. 4, 2003

(54) HIGH-PRESSURE FUEL PUMP CONTROL DEVICE AND IN-CYLINDER INJECTION ENGINE CONTROL DEVICE

(75) Inventors: Kosaku Shimada, Hitachinaka (JP); Hiroyuki Yamada, Hitachinaka (JP); Takashi Okamoto, Hitachinaka (JP); Asahiko Otani, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/746,070

(22) Filed: Dec. 26, 2000

(65) Prior Publication Data

US 2001/0006061 A1 Jul. 5, 2001

(30) Foreign Application Priority Data

Dec. 24, 1999 (JP) ..... 11-368173

(51) Int. Cl.[7] ..... F02M 37/04
(52) U.S. Cl. ..... 123/495; 123/497
(58) Field of Search ..... 123/499, 495, 123/514, 506, 456, 447, 459; 417/440, 470

(56) References Cited

U.S. PATENT DOCUMENTS 6,135,090 A * 10/2000 Kawachi et al. ..... 123/446
6,167,870 B1 * 1/2001 Sakasai ..... 123/500
6,318,343 B1 * 11/2001 Nakagawa et al. ..... 123/500
6,336,445 B1 * 1/2002 Yamazaki et al. ..... 123/506
2001/0043874 A1 * 11/2001 Sano et al. ..... 417/440

FOREIGN PATENT DOCUMENTS

JP 11-125140 * 11/1999

* cited by examiner

*Primary Examiner*—Willis R. Wolfe
*Assistant Examiner*—Mahmoud Gimie
(74) *Attorney, Agent, or Firm*—Crowell & Moring LLP

(57) ABSTRACT

A high-pressure fuel pump accelerates a rise in fuel pressure from engine start-up to shorten an engine start-up time, reduce an exhaust gas substance and improve or increase an engine output. The high-pressure fuel pump is part of a control device which controls an in-cylinder injection engine having a fuel injection valve, a high-pressure fuel pump, and a crank angle sensor. The high-pressure fuel pump is provided with a plunger for pressurizing the fuel placed in the high-pressure fuel pump, a pump drive cam, and a cam angle sensor. A drive signal setting device outputs drive signals to the high-pressure fuel pump at least two or more times from the time of crank angle sensor signal detection to the determination time of the crank and cam angle sensor phases.

17 Claims, 22 Drawing Sheets

HIGH-PRESSURE FUEL PUMP CONTROL DEVICE AND IN-CYLINDER INJECTION ENGINE CONTROL DEVICE

BACKGROUND OF THE INVENTION

The present invention relates to a high-pressure fuel pump control device and an in-cylinder injection engine control device, and particularly to a high-pressure fuel pump control device and an in-cylinder injection engine control device for controlling the operation of a high-pressure fuel pump for force-feeding a high pressure fuel to a common rail of a fuel injection valve.

The present vehicle needs to reduce exhaust gas substance such as carbon monoxide (CO), hydrocarbon (HC), nitrogen oxides (Nox), etc. contained in a vehicle exhaust gas from the view point of environment protection. The development of a direct injection engine (in-cylinder injection engine) has been done with the aim of reducing these gas substances. The in-cylinder injection engine directly injects a fuel from a fuel injection valve within a combustion chamber in a cylinder. Further, the fuel injected from the fuel injection valve is reduced in particle diameter to thereby promote or accelerate the combustion of the injected fuel and achieve a reduction in exhaust gas substance and an improvement in engine output, etc.

Reducing the particle diameter of the fuel injected from the fuel injection valve here needs means for bringing the fuel to high pressure. Various technologies for a high-pressure fuel pump for force-feeding a high pressure fuel to the fuel injection valve have been proposed (see, for example, Japanese Patent No. 2690734, Japanese Patent Laid-open No. Hei 10-153157, etc.)

The technology disclosed in Japanese Patent Application No. 2690734 relates to a variable delivery or discharge rate high-pressure pump for force-feeding a high pressure fuel to within a common rail (oil-storage path shared between cylinders) of a fuel injection device. The variable discharge rate high-pressure pump comprises a cylinder, a plunger driven by an engine built in the cylinder a pressure chamber formed by an upper end surface of the plunger and an inner peripheral surface of the cylinder, and an electromagnetic valve which faces the pressure chamber and is fixed to the cylinder. The variable discharge rate high-pressure pump is one in which the electromagnetic valve is energized to thereby close a low pressure path communicating with the pressure chamber, and the fuel placed in the pressure chamber increases in pressure owing to the elevation of the plunger so as to be force-fed to the common rail and hence the electromagnetic valve is opened or closed, whereby the amount of delivery or discharge of the fuel to the common rail is adjusted.

On the other hand, the technology disclosed in Japanese Patent Laid-open No. Hei 10-153157 relates to a variable discharge rate high-pressure pump for adjusting or controlling the amount of a fuel supplied to an engine by a fuel spill valve corresponding to an electromagnetic valve. The variable discharge rate high-pressure pump comprises a cylinder, a plunger built in the cylinder, and a pressure chamber formed by an upper end surface of the plunger and an inner peripheral surface of the cylinder. An inflow path for allowing the fuel to flow from a low pressure feed pump, a supply path for force-feeding a high-pressure fuel to a common rail, and a spill path communicating with a fuel spill valve for returning a fuel spilt from the pressure chamber to a fuel tank are connected to the pressure chamber. The fuel spill valve is opened or closed to thereby control the amount of delivery of the fuel to the common rail.

Meanwhile, the conventional technology disclosed in Japanese Patent Application No. 2690734 has a problem in that the electromagnetic valve which opens or closes the common rail, must be set to an always-opened type to control or suppress the occurrence of a vapor lock due to a substantial reduction in the pressure in the pressure chamber at a suction stroke of the plunger, and when the delivery of a fuel in maximum flow rate from the pressure chamber is made, a loss of a pressure-applying time due to an open delay in the electromagnetic valve occurs when the plunger shifts to a compression stroke, and the capability of fuel delivery is reduced, whereas when the delivery of a fuel in small flow rate from the pressure chamber is made, almost all time necessary for the compression stroke of the plunger is spent in maintaining the electromagnetic valve in an open state, whereby the electromagnetic valve must be opened or closed within a slight time lying between the intake stroke and compression stroke of the plunger.

In the conventional technology disclosed in Japanese Patent Laid-open No. Hei 10-153157, the inflow path and the spill path are provided separately, and the intake stroke of the plunger and the opening and closing of the spill valve are out of relation to the inflow of the fuel. Therefore, the above-described problem is solved. It is however necessary to provide valve sheets at two points with respect to the intake valve for the inflow path and the spill valve for the spill path in addition to a size increase in the variable discharge rate high-pressure pump due to the provision of the spill path. It is also necessary to improve the accuracy of processing of each valve sheet with a view toward preventing a reduction in delivery capability due to leakage of the fuel from the valve sheet. Therefore, the manufacturing cost increases and continuous energization must be carried out while the spill valve is being closed, thus causing inconvenience that power consumption will increase.

Further, any of the respective conventional technologies has a problem in that the operation of the electromagnetic valve must completely be synchronized with the reciprocating stroke of the plunger, and the high response of the electromagnetic valve and the high accuracy of a synchronizing signal are required, whereby a system necessary therefore becomes very expensive.

Here, the present applicant has studied with a view toward solving the above-described problems and proposed the inventions of variable discharge rate high-pressure pumps as the preceding applications in various ways. There is known, for example, a technology of a variable discharge rate high-pressure pump wherein when pressure on the downstream side (pressure chamber side) of an intake valve in an inflow path is equal to that on the upstream side (inflow path side) of the intake valve or greater than that due to a change in the volume of a pressure chamber by a plunger reciprocated according to the rotation of a cam, a push rod is provided in which a valve closing spring urged so as to close the intake valve is provided to close the intake valve and a valve opening spring urged so as to open the intake valve is provided, and the push rod is activated according to the energization or de-energization of a solenoid. Further, the above-described problems are solved owing to the separate provision of the intake valve and the electromagnetic valve, the separate provision of the intake valve and the push rod, and the configuration free of the provision of the valve sheets at the two points, etc.

Meanwhile, an operation timing chart from the start-up of an engine by the variable discharge rate high-pressure pump is shown in FIG. 22. It is understood that the time between the determination of a crank angle signal after the beginning of cranking from the engine start-up and the determination of a plunger phase between the crank angle signal and a cam angle signal for driving a plunger no allows the output of a solenoid control signal, a first solenoid control signal is outputted based on a REF signal only after the plunger phase is established, thereby force-feeding a high pressure fuel to a common rail to start a rise in fuel pressure, and when a second solenoid control signal is outputted to force-feed a fuel to the common rail, a fuel injection valve has fuel pressure 22*b*.

Thus, as shown in FIG. 22, even when the plunger shifts to a compression stroke via a bottom dead center from its stop position 22*a* during the time that elapsed before the determination of the plunger phase, the intake valve cannot be closed. A rise in fuel pressure cannot be achieved during this time, and a time delay up to target fuel pressure is developed. A problem arises in that this causes the lengthening of an engine start-up time and delays the atomizing of an atomized particle size by a fuel injection valve, thus exerting a large influence on the amount of exhaust of HC.

Thus, the present inventors have obtained new findings that it is necessary to control a high-pressure fuel pump in order to allow the force-feeding of a high pressure fuel to the common rail even during the period of from the start of the cranking to the determination of the plunger phase between the crank angle signal and the cam angle signal. However, any of the conventional technologies does not pay particular attention to the planning of the promotion of a rise in fuel pressure from the engine start-up.

SUMMARY OF THE INVENTION

The present invention has been made in view of such problems. An object of the present invention is to provide a high-pressure fuel pump control device and an in-cylinder injection engine control device capable of causing a high-pressure fuel pump to promote a rise in fuel pressure from the start-up of an engine, and achieving the shortening of an engine start-up time, a reduction in exhaust gas substance and an increase in engine output, etc.

There is provided a high-pressure fuel pump control device and an in-cylinder injection engine control device according to the present invention, for achieving the above object, which basically includes a fuel injection valve provided in a cylinder, a high-pressure fuel pump for force-feeding a fuel to the fuel injection valve, and a crank angle sensor for detecting the position of a crankshaft of the cylinder. The high-pressure fuel pump includes a plunger for pressurizing the fuel placed in the high-pressure fuel pump, a pump drive cam for driving the plunger, and a cam angle sensor for detecting the position of the pump drive cam. The high-pressure fuel pump control device and in-cylinder injection engine control device include drive signal setting means for outputting drive signals to the high-pressure fuel pump at least two or more times from the time of signal detection of the crank angle sensor to the time of determination of phases of the crank angle sensor and the cam angle sensor.

Further, the high-pressure fuel pump control device and-in-cylinder injection engine control device control an in-cylinder injection engine having a fuel injection valve provided in a cylinder, and a high-pressure fuel pump for force-feeding a fuel to the fuel injection valve. The high-pressure fuel pump includes a plunger for pressurizing the fuel placed in the high-pressure fuel pump, and a pump drive cam for driving the plunger. The high-pressure fuel pump control device and in-cylinder injection engine control device include drive signal setting means for repeatedly outputting drive signals each having a determined width to the high-pressure fuel pump in a predetermined cycle during a period in which the plunger is reciprocated once from the start-up of the in-cylinder injection engine.

The high-pressure fuel pump control device and in-cylinder injection engine control device of the present invention constructed as described above repeatedly output the drive signals each having the predetermined width to the high-pressure fuel pump in the predetermined cycle for a period of from the time of signal detection of the crank angle-sensor for detecting the position of the crankshaft of the cylinder to the time of the determination of the phases of the crank angle sensor and the cam angle sensor for detecting the position of the pump drive cam, i.e., even in a state in which the plunger phase at the engine start-up cannot be detected. Therefore, any of the drive signals is applied in the neighborhood of the bottom dead center of the plunger to promote fuel pressure from the engine start-up, whereby a engine start-up time can be shortened, and a reduction in the amount of exhaust of an exhaust gas substance and an increase in engine output, etc. can be achieved.

Further, the drive signal setting means can also repeatedly output the drive signals each having the predetermined width to the high-pressure fuel pump in the predetermined cycle regardless of the engine start-up. Thus, even when signals outputted from the crank angle sensor and the cam angle sensor fall into a state unable to be absolutely detected due to a break or the like, the fuel can be force-fed to the fuel injection valve, thereby making it possible to achieve fail-safe.

According to a specific aspect of a high-pressure fuel pump control device and in-cylinder injection engine control device according to the present invention, the high-pressure fuel pump control device and in-cylinder injection engine control device output each drive signal to the high-pressure fuel pump in synchronism with the rising edge or falling edge of a signal outputted from the crank angle sensor for detecting the position of the crankshaft in the cylinder or in synchronism with the rising edge and the falling edge thereof.

Further, the pump drive cam is characterized in that its position is detected by a signal outputted from a cam angle sensor for detecting the position of a cam shaft of an exhaust valve or intake valve in the cylinder, or that its position is detected by a signal outputted from the cam angle sensor for detecting the position of the crankshaft in the cylinder.

Furthermore, the high-pressure fuel pump control device and in-cylinder injection engine control device include detection signal switching means for performing switching to the signal outputted from the cam angle sensor for detecting the position of the cam shaft of the intake valve in the cylinder or the signal outputted from the crank angle sensor for detecting the position of the crankshaft in the cylinder when the signal of the cam angle sensor for detecting the position of the cam shaft of the exhaust valve in the cylinder cannot be detected. The high-pressure fuel pump control device and in-cylinder injection engine control device also include detection signal switching means for performing switching to the signal outputted from the cam angle sensor for detecting the position of the cam shaft of the exhaust valve in the cylinder or the signal outputted from the crank angle sensor for detecting the position of the crankshaft in the cylinder when the signal of the cam angle sensor for detecting the position of the cam shaft of the intake valve in the cylinder cannot be detected. The high-pressure fuel pump control device and in-cylinder injection engine control device further include another drive signal setting means for repeatedly outputting the drive signals each having the predetermined width to the high-pressure fuel pump in the predetermined cycle when the signal outputted from the crank angle sensor for detecting the position of the crankshaft in the cylinder cannot be detected.

Further, according to another specific aspect of a high-pressure fuel pump control device and in-cylinder injection engine control device according to the present invention, the high-pressure fuel pump control device and in-cylinder injection engine control device include variable valve timing driving means for controlling timing provided to open or close the intake valve or exhaust valve in the cylinder. When the signal outputted from the cam angle sensor for detecting the position of the cam shaft of the intake valve or exhaust valve in the cylinder cannot be detected, the high-pressure fuel pump control device and in-cylinder injection engine control device stop control of open/close timing by the variable valve timing driving means. When the control of the open/close timing by the variable valve timing driving means is discontinued, the high-pressure fuel pump control device and in-cylinder injection engine control device are provided with another drive signal setting means for repeatedly outputting drive signals each having a predetermined width to the high-pressure fuel pump in a predetermined cycle. When the control of the open/close timing by the variable valve timing driving means is resumed, the high-pressure fuel pump control device and in-cylinder injection engine control device return another drive signal setting means to the drive signal setting means.

Furthermore, the high-pressure fuel pump comprises a pump chamber, a solenoid chamber and a cylinder chamber. The pump chamber includes an intake valve provided on the solenoid chamber side and a valve closing spring urged in a direction to close the intake valve. The solenoid chamber includes a solenoid, an intake valve engagement member brought into engagement with the intake valve, and a valve opening spring urged in a direction to open the intake valve.

A high-pressure fuel pump control device and in-cylinder injection engine control device control an in-cylinder injection engine including a fuel injection valve provided in a cylinder, a high-pressure fuel pump for force-feeding a fuel to the fuel injection valve, and a crank angle sensor for detecting the position of a crankshaft in the cylinder. The high-pressure fuel pump includes a plunger for pressurizing the fuel placed in the high-pressure fuel pump, based on a solenoid signal, a pump drive cam for driving the plunger, and a cam angle sensor for detecting the position of the pump drive cam. The high-pressure fuel pump control device and in-cylinder injection engine control device include basic angle computing means for computing a basic angle of the solenoid signal, based on a detected signal outputted from a fuel pressure sensor attached to the fuel injection valve, target fuel pressure calculating means for calculating target pressure, and fuel pressure input processing means for outputting actual fuel pressure, solenoid control signal computing means for computing a reference angle of the solenoid signal, based on these respective means, state transition determining means for determining the state of the in-cylinder injection engine and causing the same to transition, and solenoid driving means for driving a solenoid of the high-pressure fuel pump. The solenoid control signal computing means includes an equal-interval energization control block for giving drive signals to the high-pressure fuel pump at least two or more times from the time of signal detection of the crank angle sensor to the time of determination of the phases of the crank angle sensor and the cam angle sensor, and a feedback control block subsequent to the complete explosion of the in-cylinder injection engine. The respective control blocks are transitioned by the state transition determining means. The high-pressure fuel pump control device and in-cylinder injection engine control device further include solenoid actuation delay correcting means for correcting a delay in actuation of the solenoid, based on the reference angle of the solenoid signal, which is calculated by the solenoid control signal computing means.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DESCRIPTION OF THE PREFERRED EMBODIMENTS

One embodiment of a high-pressure fuel pump control device and an in-cylinder injection engine control device according to the present invention will hereinafter be described with reference to the accompanying drawings.

Figure 1:
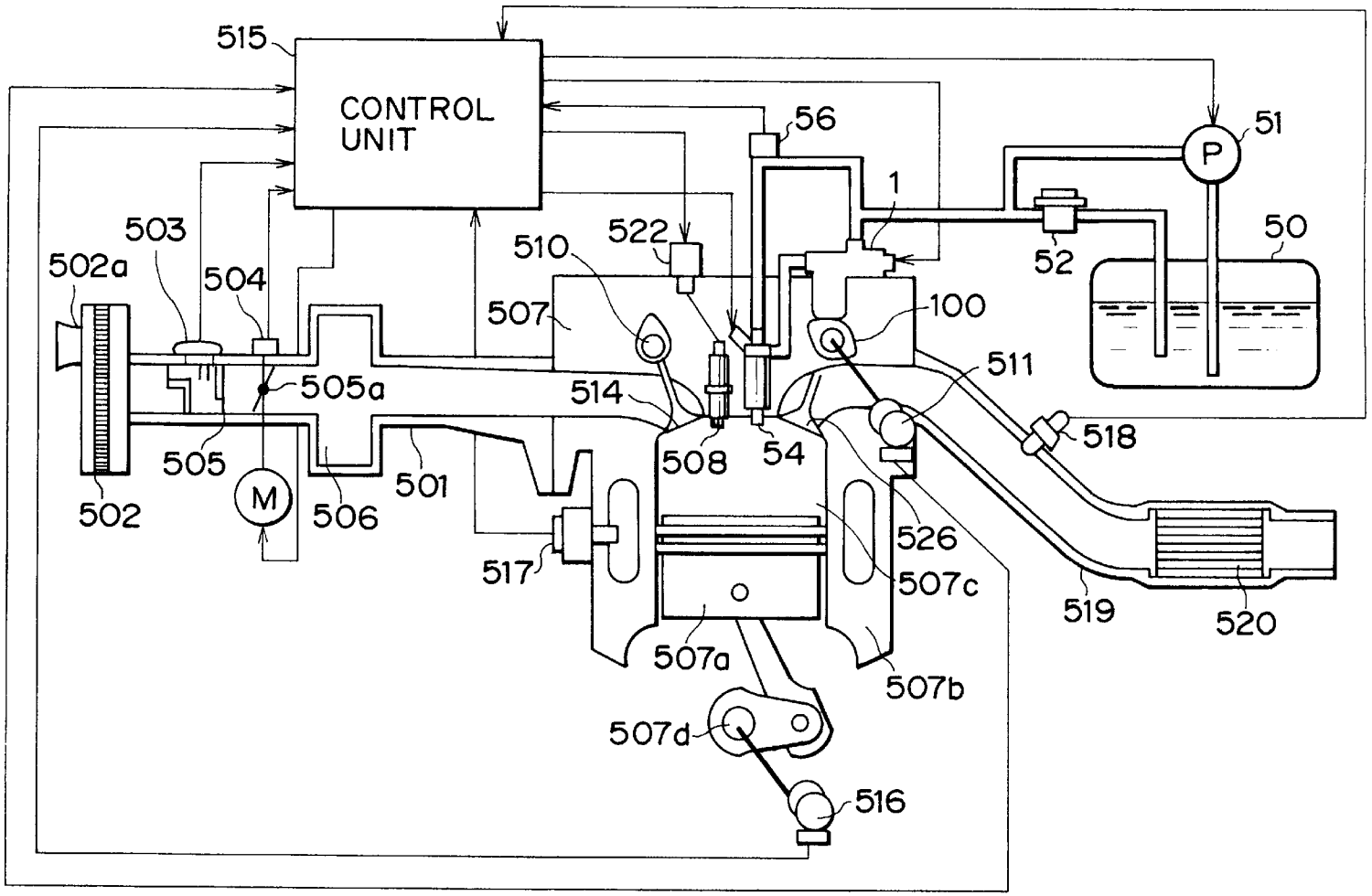
FIG. 1 is an overall structural view of an engine equipped with a high-pressure fuel pump control device and an in-cylinder injection engine control device according to the present embodiment.

FIG. 1 shows an overall structure of a control system of an in-cylinder injection engine 507 according to the present embodiment. The in-cylinder injection engine 507 comprises four cylinders. Air introduced into each individual cylinders 507*b* is taken in through an inlet 502*a* of an air cleaner 502 and passes through an airflow meter (airflow sensor) 503. Further, the air passes through a throttle body 505 in which an electronic controlled throttle valve 505*a* for controlling the amount of intake air or intake air flow is held or accommodated, followed by entering a collector 506. The air taken in the collector 506 is distributed to each individual intake pipes 501 respectively connected to the cylinders 507*b* of the engine 507 and thereafter introduced into a combustion chamber 507*c* formed by a piston 507*a*, the cylinders 507*b*, etc.

The airflow sensor 503 outputs a signal indicative of the intake air flow to a high-pressure fuel pump control device and an in-cylinder injection engine control device (control unit) 515. Further, a throttle sensor 504 for detecting the degree of opening of the electronic controlled throttle valve 505*a* is attached to the throttle body 505. A signal detected by the throttle sensor 504 is also outputted to the control unit 515.

On the other hand, a fuel such as gasoline is primary-pressurized by a fuel pump 51 through a fuel tank 50 and pressure-controlled to predetermined pressure (e.g., 3 kg/cm$^2$) by a fuel pressure regulator 52. Further, the fuel is secondary-pressurized to high pressure (e.g., 50 kg/cm$^2$) by a high-pressure fuel pump 1 to be described later, which in turn is injected into the combustion chamber 507*c* from fuel-injection valves (injectors) 54 provided in each individual cylinders 507*b* through a common rail 53. The fuel injected into the combustion chamber 507*c* is ignited at a spark plug 508 by an ignition or spark signal brought to a high voltage by an ignition coil 522.

A crank angle sensor 516 attached to a crankshaft 507*d* of the engine 507 outputs a signal indicative of the position of rotation of the crankshaft 507*d* to the control unit 515. A cam angle sensor 511 attached to a cam shaft (not shown) of an exhaust valve 526 outputs a reference angle signal indicative of the position of rotation of the cam shaft to the control unit 515 and also outputs a reference angle signal indicative of the position of rotation of a pump drive cam 100 of the high-pressure fuel pump 1. Further, an A/F sensor 518 provided on the upstream side of a catalyst 520 in an exhaust pipe 519 detects an exhaust gas and outputs a detected signal thereof to the control unit 515. Incidentally, timing provided to open or close an intake valve 514 through valve timing driving means (not shown) is controlled or adjusted to the cam shaft 510 of the intake valve 514.

Figure 2:
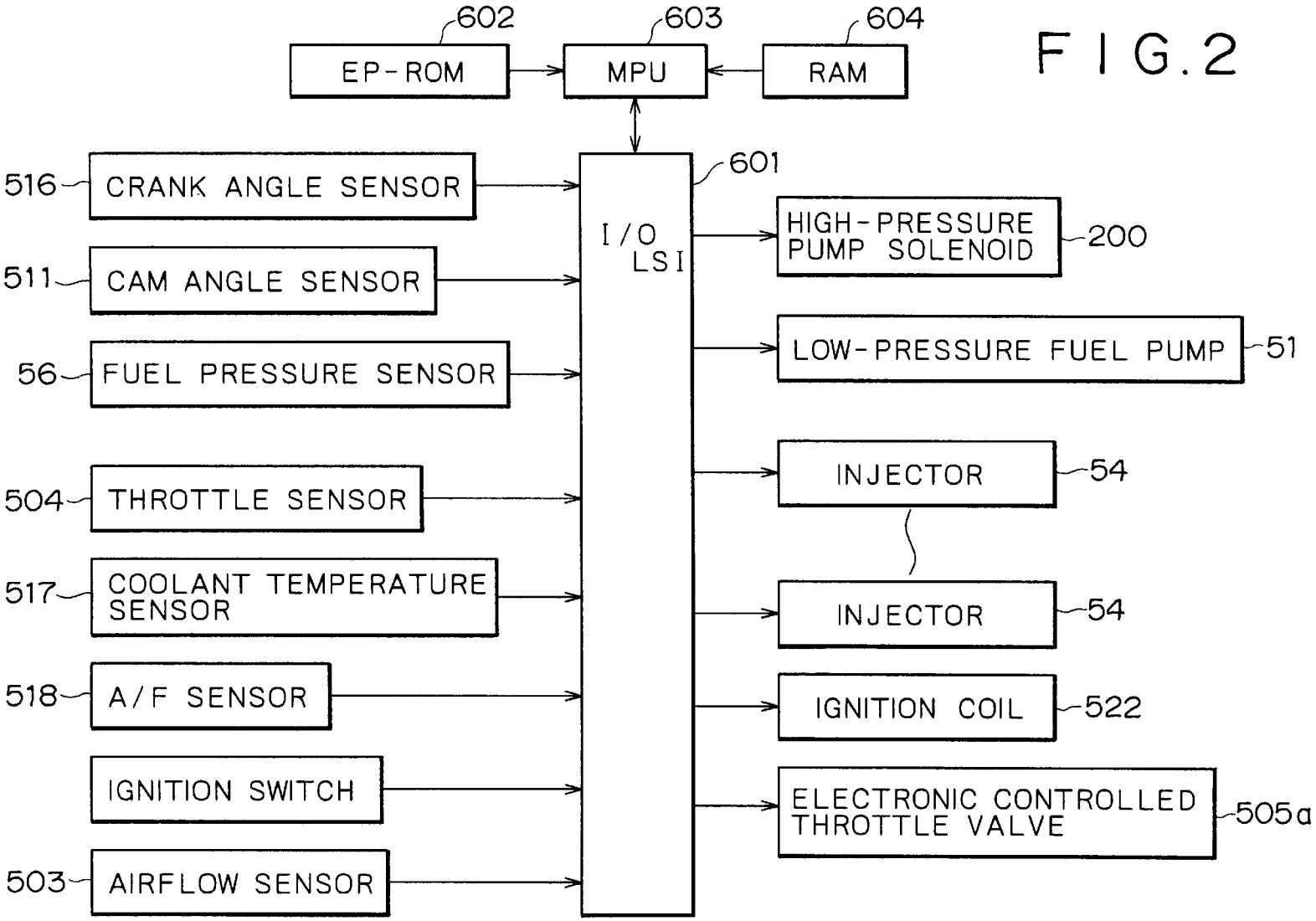
FIG. 2 is an internal structural view of the high-pressure fuel pump control device and in-cylinder injection engine control device shown in FIG. 1.

As shown in FIG. 2, a principal part of the control unit 515 comprises an MPU 603, an EP-ROM 602, a RAM 604, and an I/O LSI 601 including an A/D converter, etc. The principal part thereof takes in or captures signals outputted from various sensors including the crank angle sensor 516, the cam angle sensor 511, an engine coolant temperature sensor 517 and a fuel pressure sensor 56, etc. as inputs to thereby execute predetermined arithmetic processing and outputs various control signals computed as such an arithmetic result. Further, it supplies predetermined control signals to a solenoid 200, the injectors 54, the ignition coil 522, etc. to thereby execute individual control of a fuel discharge rate, a fuel supply or charge rate, ignition timing, etc.

Figure 3:
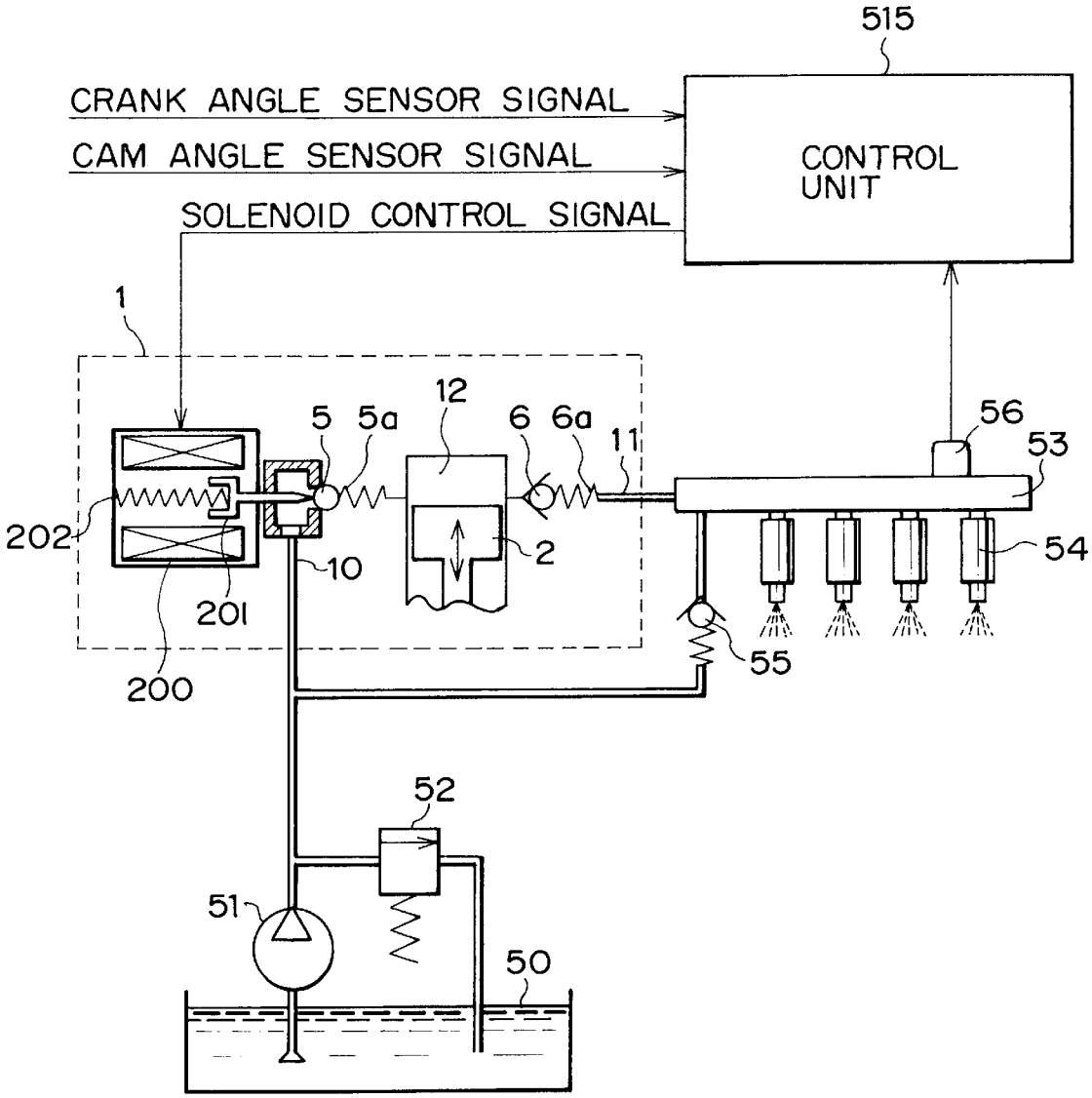
FIG. 3 is an overall structural view of a fuel system equipped with a high-pressure fuel pump shown in FIG. 1.
Figure 4:
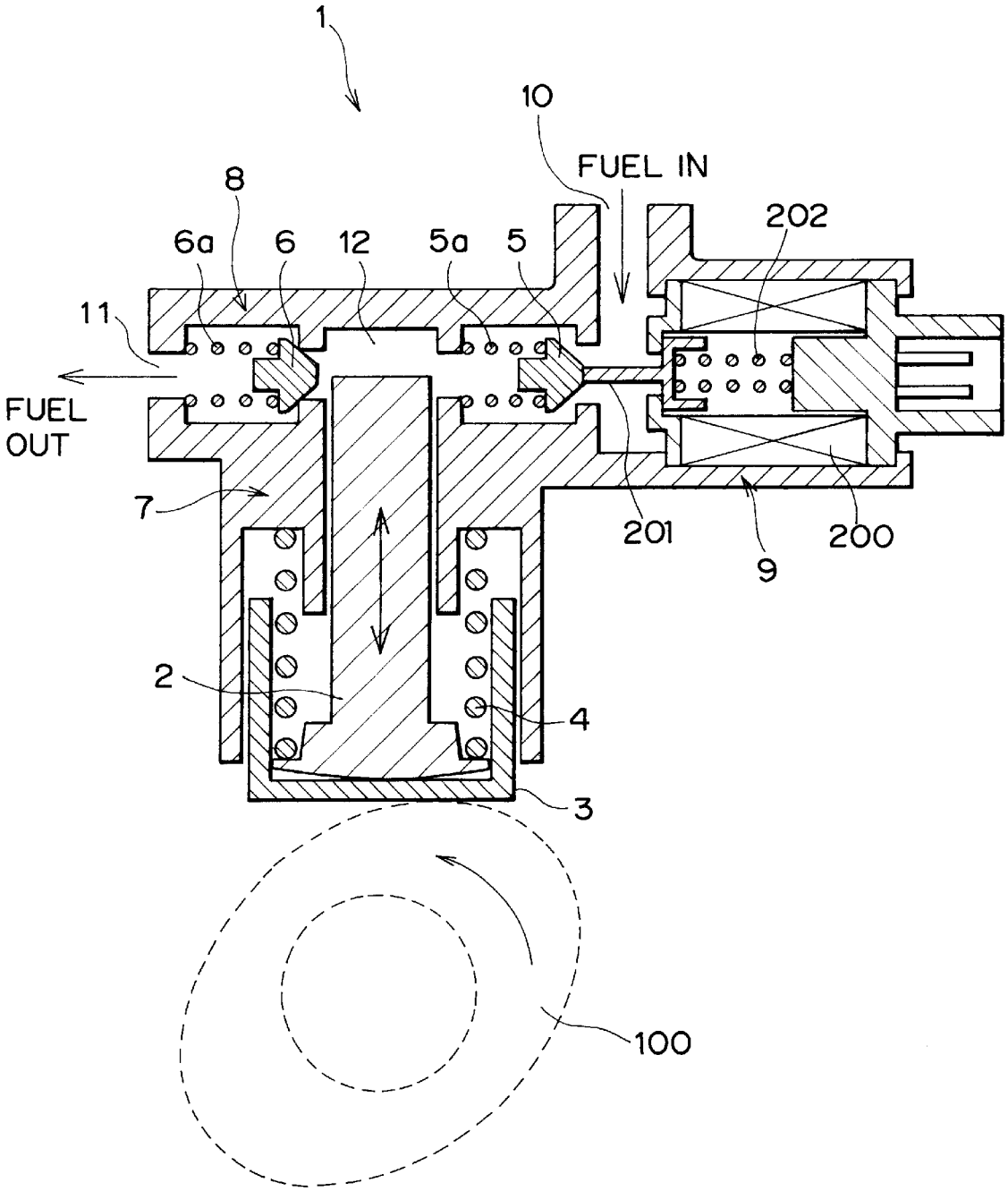
FIG. 4 is a vertical sectional view of the high-pressure fuel pump shown in FIG. 3.

FIGS. 3 and 4 show the high-pressure fuel pump 1. FIG. 3 depicts an overall structural view of a fuel-based system equipped with the high-pressure fuel pump 1, and FIG. 4 shows a vertical cross-section of the high-pressure fuel pump 1, respectively.

The high-pressure fuel pump 1 pressurizes the fuel fed from the fuel tank 50 and force-feeds the high-pressure fuel to the common rail 53. It comprises a cylinder chamber 7, a pump chamber 8 and a solenoid chamber 9. The cylinder chamber 7 is placed below the pump chamber 8 and the solenoid chamber 9 is placed in the right hand of the pump chamber 8.

The cylinder chamber 7 has a plunger 2, a lifter 3, and a plunger-down spring 4. The plunger 2 moves forward and backward alternately through the lifter 3 press-fit to the pump drive cam 100 rotated with the rotation of the cam shaft of the exhaust valve 526 in the engine 507 to change the volume of a pressure chamber 12 in the pump chamber 8.

The pump chamber 8 comprises a low-pressure fuel intake path 10, the pressure chamber 12, and a high-pressure fuel delivery path 11. An intake valve 5 is provided between the intake path 10 and the pressure chamber 12. The intake valve 5 is a check valve for restricting the direction of circulation of the fuel through the use of a valve closing spring 5*a* urged in a valve-closing direction of the intake valve 5 from the pump chamber 8 to the solenoid chamber 9. A delivery valve 6 is provided between the pressure chamber 12 and the delivery path 11. The delivery valve 6 is also a check valve for restricting the direction of circulation of the fuel through the use of a valve closing spring 6*a* urged in a valve-closing direction of the delivery valve 6 from the pump chamber 8 to the solenoid chamber 9. Incidentally, the valve closing spring 5*a* pinches the intake valve 5 according to a change in the volume in the pressure chamber 12 by the plunger 2 and is urged so as to close the intake valve 5 when pressure on the pressure chamber 12 side is equal to pressure on the intake path 10 side or reaches the pressure or higher.

The solenoid chamber 9 comprises a solenoid 200, an intake valve engagement member 201 and a valve opening spring 202. The intake valve engagement member 201 has a tip or leading end separably brought into contact with the intake valve 5. Further, the intake valve engagement member 201 is disposed in a position relative to the intake valve 5 and moves in a direction to close the intake valve 5 under the energization of the solenoid 200. On the other hand, when the solenoid 200 is in a de-energized state, the intake valve engagement member 201 is shifted in a direction to open the intake valve 5 through the valve opening spring 202 brought into engagement with the rear end of the intake valve engagement member 201 to thereby bring the intake valve 5 to a valve-opened state.

The fuel fed from the fuel tank 50, which is pressure-controlled to the predetermined pressure by the fuel pump 51 and the fuel pressure regulator 52, is introduced into the intake path 10 of the pump chamber 8. Afterwards, the fuel is pressurized under the reciprocation of the plunger 2 within the pressure chamber 12 of the pump chamber 8 and force-fed from the delivery path 11 of the pump chamber 8 to the common rail 53.

The common rail 53 is provided with a relief valve 55 and a fuel pressure sensor 56 in addition to each individual injectors 54 provided in accordance with the number of cylinders of the engine. The control unit 515 outputs a drive signal for the solenoid 200, based on each of individual detected signals of the crank angle sensor 516, the cam angle sensor 511 and the fuel pressure sensor 56 to thereby control the delivery of the fuel. Further, the control unit 515 outputs a drive signal for each injector 54 to control the injection of the fuel. Incidentally, when the pressure in the common rail 53 exceeds a predetermined value, the relief valve 55 is opened to prevent damage of a piping system.

Figure 5:
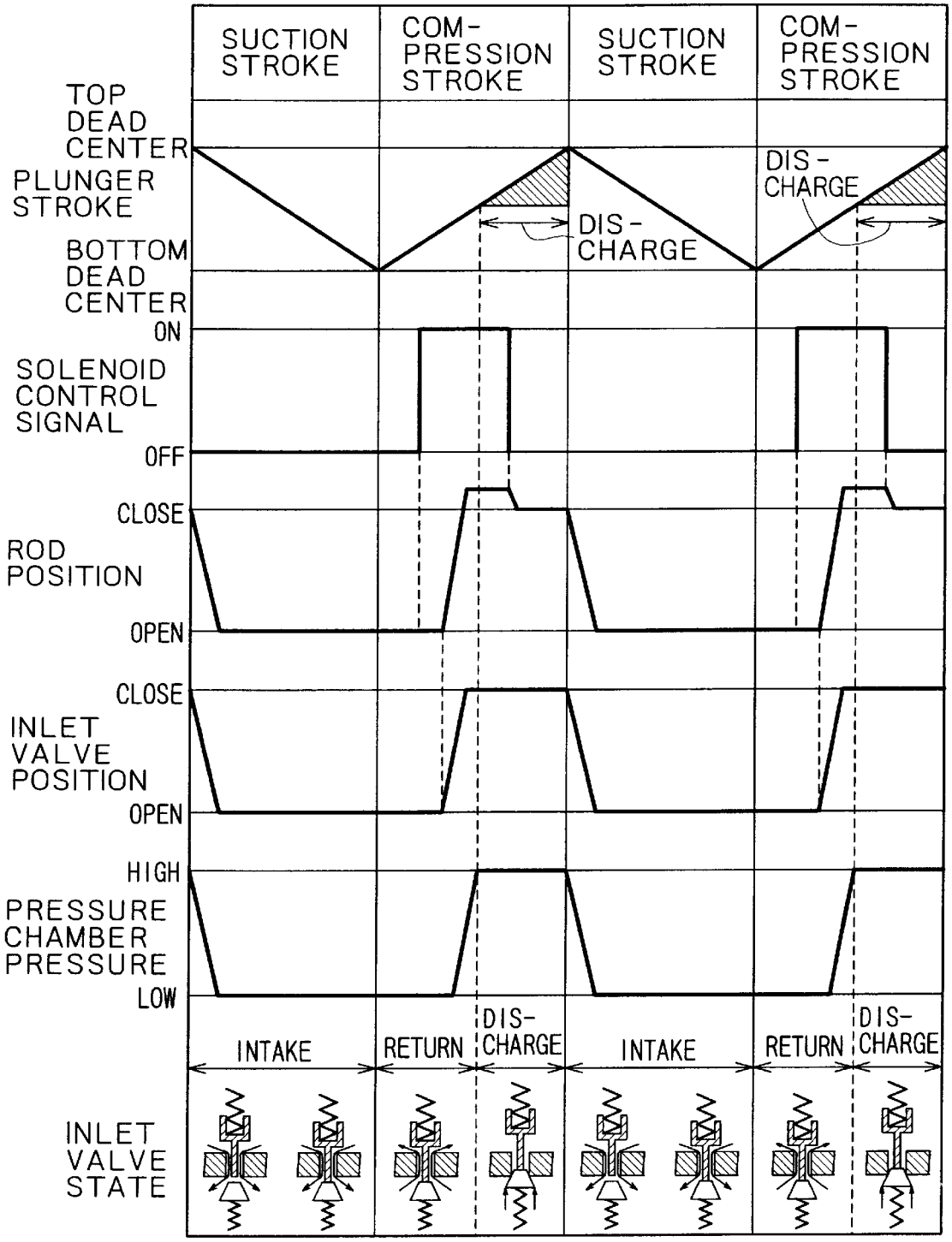
FIG. 5 is an operation timing chart of the high-pressure fuel pump shown in FIG. 3.
Figure 6:
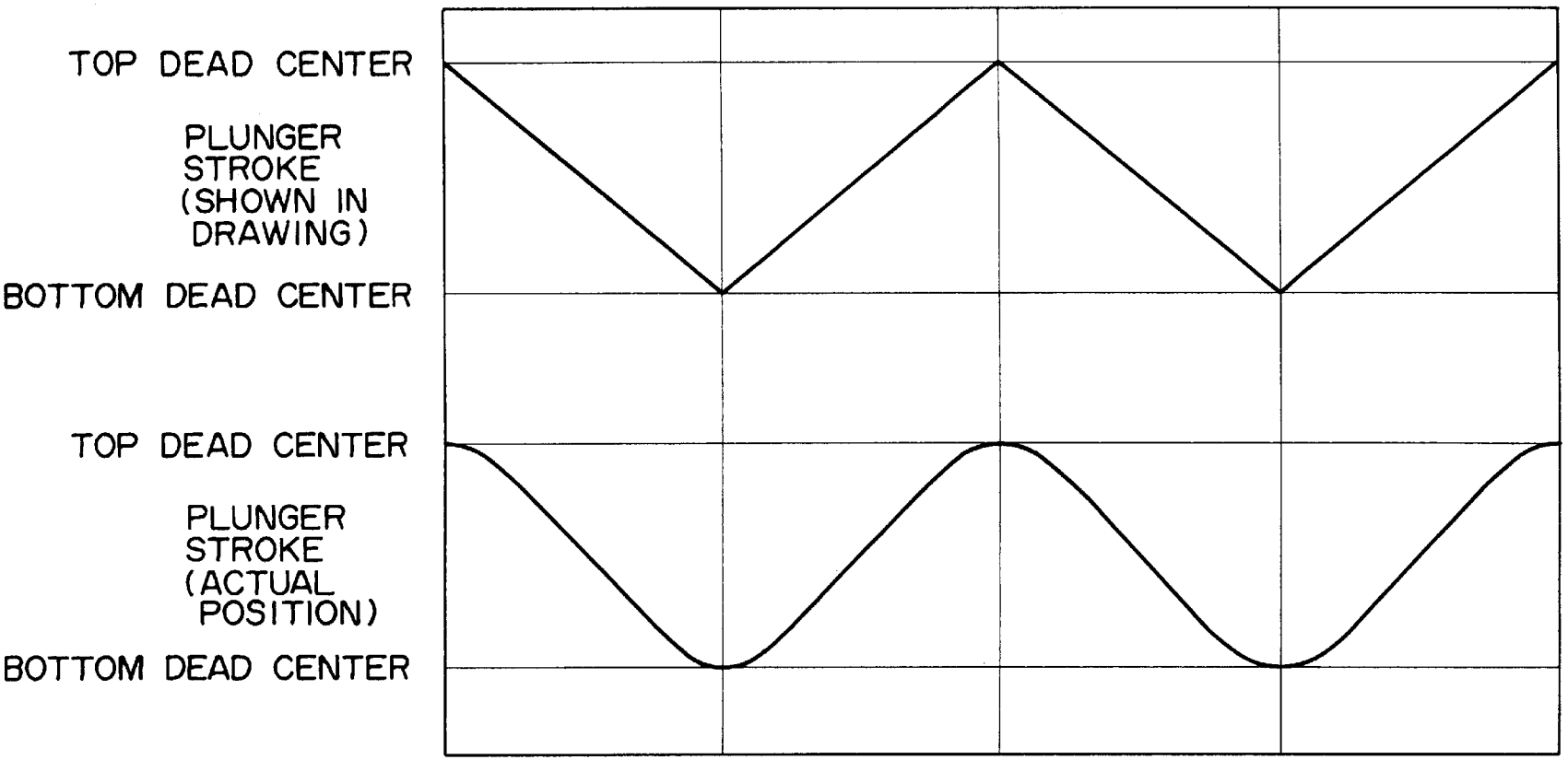
FIG. 6 is a supplementary explanatory view of the operation timing chart shown in FIG. 5.

FIG. 5 shows an operation timing chart of the high-pressure fuel pump 1. Incidentally, the actual stroke (actual position) of the plunger 2 driven by the pump drive cam 100 is given as such a curve as shown in FIG. 6. However, the stroke of the plunger 2 will be represented linearly below to make it easy to understand positions of a top dead center and a bottom dead center thereof.

When the plunger 2 shifts from the top dead center to the bottom dead center according to an urging force of the plunger-down spring 4 under the rotation of the cam 100, a suction stroke of the pump chamber 8 is carried out. In the suction stroke, the position of a rod corresponding to the intake valve engagement member 201 is brought into engagement with the intake valve 5 according to an urging force of the valve opening spring 202 to thereby move the intake valve 5 in its valve-opening direction, whereby the pressure in the pressure chamber 12 is lowered.

Next, when the plunger 2 moves from the bottom dead center to the top dead center against the urging force of the plunger-down spring 4 under the rotation of the cam 100, a compression stroke of the pump chamber 8 is carried out. When the drive signal for the solenoid 200 is outputted from the control unit 515 in the compression stroke to energize the solenoid 200 (bring it to an ON state), the position of the rod corresponding to the intake valve engagement member 201 is shifted against the urging force of the valve opening spring 202 to thereby move the intake valve 5 in a valve-closing direction. Further, the tip of the rod is disengaged from the intake valve 5. Thus, the intake valve 5 is shifted in the valve-closing direction according to the urging force of the valve closing spring 5*a* to thereby increase the pressure in the pressure chamber 12. As a result, the intake valve 5 allows the maximum delivery of fuel regardless of the response of the solenoid 200.

When the intake valve engagement member 201 is most sucked into the solenoid 200 side and the intake valve 5 synchronized with the reciprocation of the plunger 2 is closed so as to bring the pressure in the pressure chamber 12 to a maximum point, the fuel lying in the pressure chamber 12 presses the delivery valve 6 and hence the delivery valve 6 is automatically opened against the urging force of the valve closing spring 6*a*, so that a high-pressure fuel corresponding to a reduction in the volume of the pressure chamber 12 is discharged to the common rail 53. Incidentally, when the intake valve engagement member 201 is most sucked into the solenoid 200, the drive signal for the solenoid 200 is outputted so as to stop its energization (bring its energization to an OFF state). However, since the pressure in the pressure chamber 12 is high as described above, the intake valve 5 is maintained in a valve-closed state and the fuel is discharged to the common rail 53. Thus, an ON-OFF high response or the like is not required.

When the plunger 2 moves from the top dead center to the bottom dead center according to the urging force of the plunger-down spring 4 under the rotation of the cam 100, the suction stroke of the pump chamber 8 is carried out. Thus, the intake valve engagement member 201 is brought into engagement with the intake valve 5 according to the urging force of the valve opening spring 202 with a reduction in the pressure in the pressure chamber 12 and is shifted in the valve-opening direction. Further, the intake valve 5 is automatically opened in synchronism with the reciprocation of the plunger 2, so that the state of opening of the intake valve 5 is held. Furthermore, the delivery valve 6 is not opened because of the occurrence of the reduction in the pressure in the pressure chamber 12. The above operation is repeated subsequently.

When the solenoid 200 is brought to an ON state in the course of the compression stroke prior to the attainment of the pressure in the pressure chamber 12 to the maximum point, the fuel is force-fed to the common rail 53 from this time. Since the pressure in the pressure chamber 12 rises once the force-feeding of the fuel starts, the intake valve 5 is maintained in a closed state even if the solenoid 200 is brought to the OFF state subsequently, whereas it can automatically be opened in synchronism with the beginning of the suction stroke, and the amount of delivery of the fuel to the common rain 53 can be adjusted according to ON timing of the solenoid 200. Further, the control unit 515 computes suitable delivery timing, based on a signal detected by the pressure sensor 56 to control the solenoid 200, whereby the pressure of the common rail 53 can be feed-back controlled to a target value.

Figure 7:
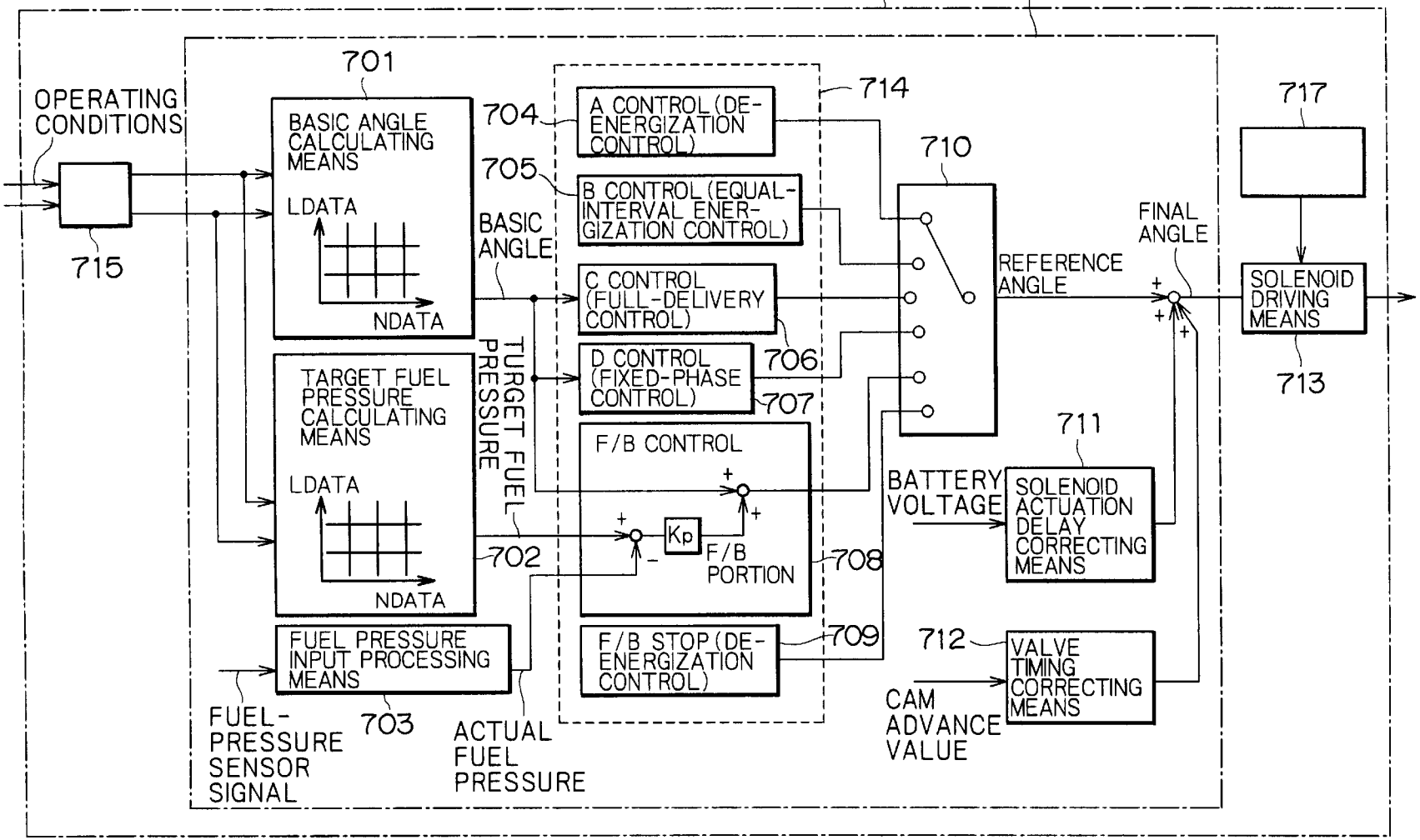
FIG. 7 is a block diagram showing control of the high-pressure fuel pump by the high-pressure fuel pump control device and in-cylinder injection engine control device shown in FIG. 1.

FIG. 7 is a block diagram showing the control of the high-pressure fuel pump 1 by the control unit 515. Drive signal setting means 716 of the control unit 515 comprises basic angle computing means 701 for computing a basic angle of a solenoid signal from the number of revolution of an engine or engine speed NDATA and an engine load LDATA, based on operating conditions of the crank angle sensor 516 and the like, target fuel pressure calculating means 702 for calculating target fuel pressure most suitable for its operating point from the engine speed NDATA and the load LDATA in the same manner as described above, fuel pressure input processing means 703 for filter-processing a signal outputted from the fuel pressure sensor 56 to thereby output actual fuel pressure, solenoid control signal computing means 714 for computing each control signal for the solenoid 200 of the high-pressure fuel pump 1, based on the basic angle computing means 701, the target fuel pressure calculating means 702 and the fuel pressure input processing means 703, state transition determining means 710 for determining the state of the in-cylinder injection engine 507 and performing its transition, solenoid actuation delay correcting means 711 for correcting an actuation delay of the solenoid 200, based on a battery voltage, valve timing correcting means 712 for correcting the difference in phase between the crankshaft 507*d* and the cam shaft, based on an advance value of the cam 100, and solenoid driving means 713 for outputting a drive signal to the solenoid 200 of the high-pressure fuel pump 1. A final angle obtained by adding a correction value made by the solenoid actuation delay correcting means 711 viewing the fact that an electromagnetic force of the solenoid 200, by extension, its actuation delay time changes according to the battery voltage, and a correction value made by the valve timing correcting means 712 viewing the fact that the influence of the valve timing driving means on a drive angle of the solenoid 200 is suppressed, to a reference angle of the solenoid signal from the solenoid control signal computing means 714 respectively, is inputted to the solenoid driving means 713.

The solenoid control signal computing means 714 comprises six control blocks to be described later, of an A control (de-energization control) block 704, a B control (equal-interval energization control) block 705, a C control (full-delivery control) block 706, a D control (fixed-phase control) block 707, an F/B control block 708, and an F/B stop (de-energization control) block 709. The transition of each control block is carried out by the state transition determining means 710 and hence the reference angle of the solenoid signal is selectively calculated.

In order to increase the reliability of the high-pressure fuel pump control device and engine control device 515, the control unit 515 is provided with detection signal switching means 715 for performing switching to the signal of the cam angle sensor of the intake valve 514 or the signal of the crank angle sensor 516 where the signal of the cam angle sensor 511 for detecting the position of the pump drive cam 100 or the like cannot be detected due to a break or the like. Incidentally, when any of the signals of the respective sensors 511, 516, etc. cannot be detected, another drive signal setting means 717 for outputting a drive signal to the high-pressure fuel pump 1, based on a table stored in the ROM 602 is provided within the control unit 515 to thereby achieve failsafe. Since the signals of the respective sensors 511, 516, etc. cannot be detected due to the break or the like as described above, the drive signal setting means 717 outputs a drive signal to the high-pressure fuel pump 1 according to the state of the engine 507 even when the valve timing driving means is not operated. This is kept doing until the valve timing driving means is operated again.

Figure 8:
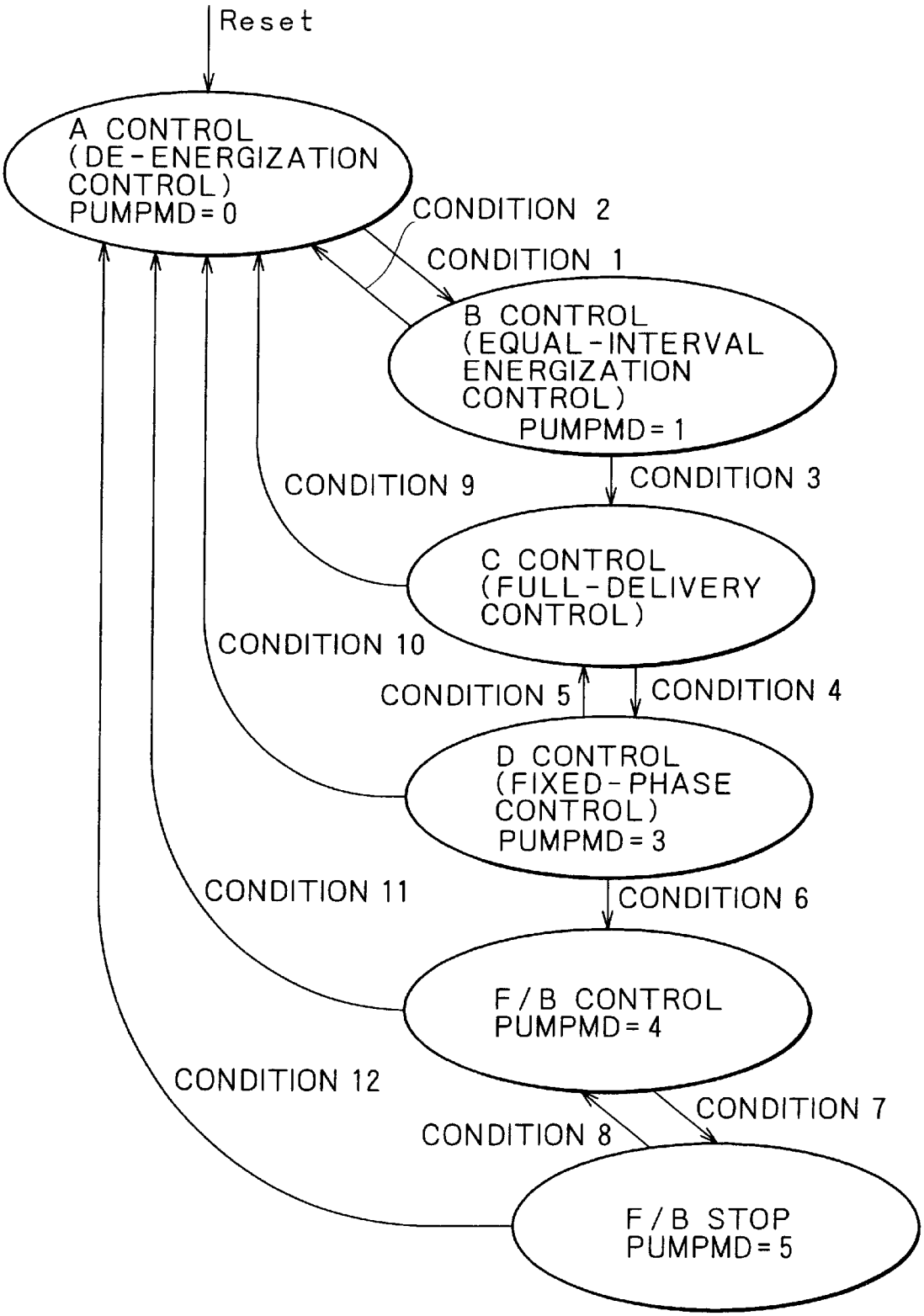
FIG. 8 is a state transition diagram of FIG. 7.

FIG. 8 is a state transition diagram of the respective control blocks from the A control block 704 to the F/B stop block 709 in the, solenoid control signal computing means 714.

When an ignition switch is changed from OFF to ON and the MPU 603 of the control unit 515 is brought to a reset state, the control unit 515 enters a de-energization control state corresponding to the A control block 704 and hence the solenoid 200 is not energized.

Next, when the ignition switch is turned ON and the engine 507 enters a cranking state to detect a crank angle signal CRANK, a condition 1 is established and hence the control unit 515 transitions to an equal-interval energization control state corresponding to the B control block 705. Now, the B control block 705 detects a pulse of the crank angle signal CRANK but does not recognize the stroke of the plunger 2, which is indicative of a REF signal. The B control block 705 is placed in a state in which a plunger phase between the crank angle signal CRANK and the cam angle signal CAM is not yet established, i.e., in a state unable to recognize the time at which the plunger 2 of the high-pressure fuel pump 1 reaches the position of the bottom dead center. In the present embodiment, the B control block 705 to be described later is selected to perform equal-interval energization, thereby outputting an intermittent solenoid control signal.

When the cranking state enters from an initial stage to a middle stage, the plunger phase between the crank angle signal CRANK and the cam angle signal CAM is established and the REF signal is recognized, a condition 3 is established, and hence the control unit 515 changes to a full-delivery control state corresponding to the C control block 706 and outputs a solenoid control signal to close the intake valve 5 from the bottom dead center of the plunger 2.

When the engine 507 is firstly detonated and the control unit 515 recognizes that the engine speed increases even though the engine 507 is not kept cranking, a condition 4 is established, and hence the control unit 515 changes to a fixed-phase control state corresponding to the D control block 707 and outputs a solenoid control signal so that the intake valve 5 is closed when it is turned by a predetermined angle from the bottom dead center of the plunger 2. Incidentally, when the engine speed reaches the predetermined value or less, a condition 5 is established and hence the control unit 515 transitions to the C control block 706.

When a predetermined time has elapsed since the complete detonation or explosion of the engine 507, a condition 6 is established and hence the control unit 515 changes to the F/B control block 708. Further, the control unit 515 performs feedback control while changing a phase in which the intake valve 5 starts to close, in such a manner that the actual fuel pressure calculated by the fuel pressure input processing means 703 reaches the target fuel pressure calculated by the target fuel pressure calculating means 702. Subsequently, the F/B control block 708 continues unless the ignition switch is turned OFF or the engine is caused to stop. However, when a fuel cut occurs due to deceleration or the like of a vehicle in the F/B control block 708, the injection of a fuel by each injector 54 is not carried out and the amount of the fuel from the common rail 53 is not reduced. Therefore, a condition 7 is established and hence the control unit 515 is caused to transition to the F/B stop block 709, where the force-feeding of the fuel from the high-pressure fuel pump 1 to the common rail 53 is stopped. Incidentally, a condition 8 is established according to the completion of the fuel cut as viewed from the F/B stop block 709 and hence the control unit 515 changes to the F/B control block 708, where it is returned to the normal feedback control. Incidentally, when the ignition switch is turned OFF and the engine stalls, conditions 2 and 9 through 12 are established and hence the control unit 515 transitions to the A control block 704.

Figure 9:
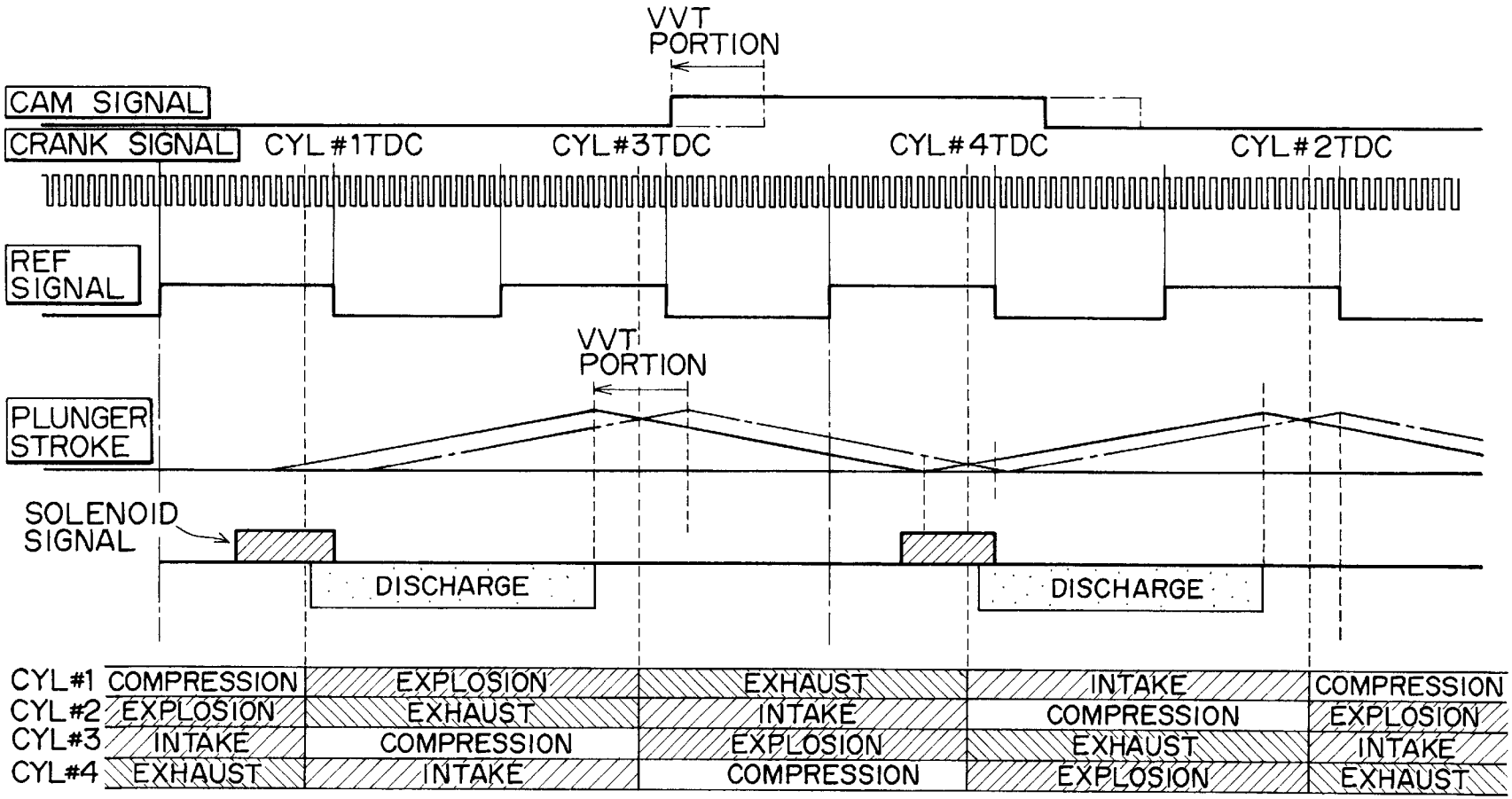
FIG. 9 is an operation timing chart of the high-pressure fuel pump control device and in-cylinder injection engine control device shown in FIG. 1.

FIG. 9 is an operation timing chart of the control unit 515. The control unit 515 detects top dead center positions of each individual pistons 507*a*, based on a detected signal (CAM signal) from the cam angle sensor 511 and a detected signal (CRANK signal) from the crank angle sensor 516 to thereby perform fuel injection control and ignition timing control. Further, the control unit 515 detects the stroke of the plunger 2, based on the detected signal (CAM signal) from the cam angle sensor 511 and the detected signal (CRANK signal) from the crank angle sensor 516 to thereby perform solenoid control indicative of fuel delivery control of the high-pressure fuel pump 1. Incidentally, the stroke of the plunger 2, which is indicative of the REF signal, is generated based on the CRANK signal and the CAM signal.

Now, portions (indicated by dotted lines) free of the CRANK signal in FIG. 9 are ones set as reference positions, each of which is placed in a position shifted by a predetermined phase from the top dead center of CYL#1 or the top dead center of CYL#4. When the CRANK signal is absent or cut off, the control unit 515 determines according to Hi or Lo of the CAM signal whether it is placed on the CYL#1 side or CYL#4 side. Incidentally, when the phase of the cam shaft of the intake valve 514 is shifted by the valve timing driving means, the phase of the CAM signal is shifted from that of the CRANK signal by a VVT portion as indicated by a dashed line and a solid line.

Meanwhile, in the present embodiment, the solenoid control is carried out with the phase at the time that the cam phase based on the valve timing driving means is of the maximum phase lag (indicated by the dashed line), as the reference, and the valve timing correcting means 712 outputs the signal advanced in phase by the VVT portion. The delivery of the fuel from the high-pressure fuel pump 1 is started after the elapse of a predetermined time interval corresponding to an actuation delay of the solenoid 200 since the rising edge of the solenoid signal. On the other hand, since the intake valve 5 is pressed by the pressure from the pressure chamber 12 even if the solenoid signal falls, the present delivery is continued until the stroke of the plunger reaches the top dead center.

Figure 10:
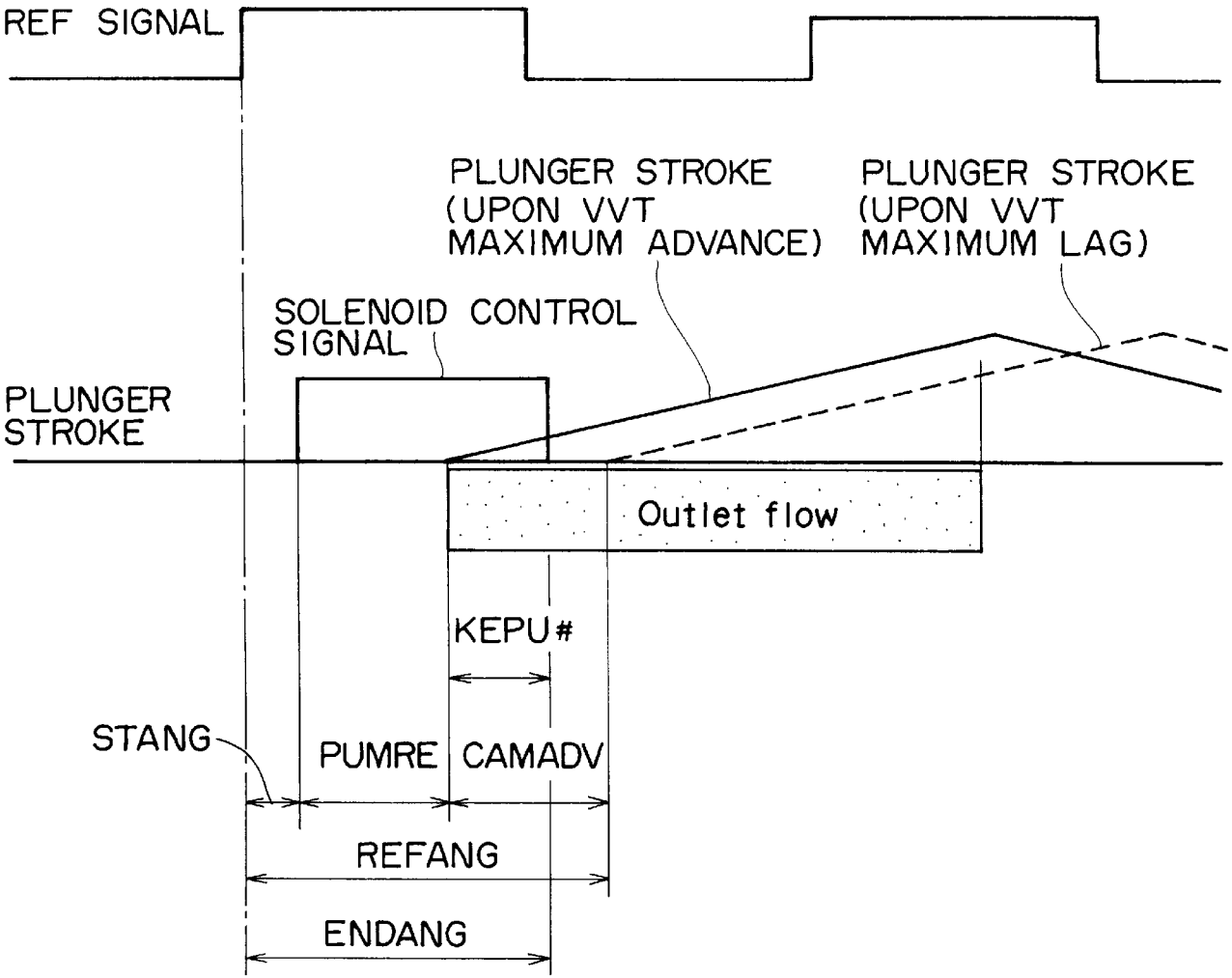
FIG. 10 is an operation timing chart of the high-pressure fuel pump control device and in-cylinder injection engine control device shown in FIG. 1.

FIG. 10 shows respective parameters used in an output start angle STANG and an output end angle ENDANG of a solenoid control signal with respect to the control of fuel pressure by the control unit 515.

The output start angle STANG and output end angle ENDANG of the solenoid signal are determined from a REF signal generated based on the CRANK signal and CAM signal, the stroke of the plunger 2, and the solenoid control signal. The output start angle STANG can first be determined as an expression 1:

$$STANG=REFANG-CAMADV-PUMRE \ldots \quad (1)$$

where REFANG indicates a basic angle, which is calculated by the basic degree of opening calculating means 701 (see FIG. 7) based on the operating state of the engine 507, and CAMADV indicates a cam advanced value, which corresponds to the angle of the VTT portion (see FIG. 9). PUMRE indicates a pump delay angle, which is calculated by the solenoid actuation delay correcting means 711 (see FIG. 7), and indicates, for example, a delay in operation of the intake valve engagement member 201, based on solenoid energization changed according to a battery voltage.

Further, the output end angle ENDANG can be determined as an expression 2:

$$ENDANG=REFANG-CAMADV+KEPU\# \ldots \quad (2)$$

where KEPU# indicates a pump holding angle, which represents a pump energization time. Incidentally, the reason why the output end angle is delayed by addition of the pump holding time KEPU# thereto, is that in the unlikely event that the electromagnetic force of the solenoid 200 is cut and thereby the intake valve engagement member 201 is brought into engagement with the intake valve 5 where it is desired to start fuel delivery from the bottom dead center of the plunger 2 upon the full delivery of the fuel, the intake valve engagement member 201 is held until the intake valve 5 is closed under the pressure in the pressure chamber 12.

Figure 11:
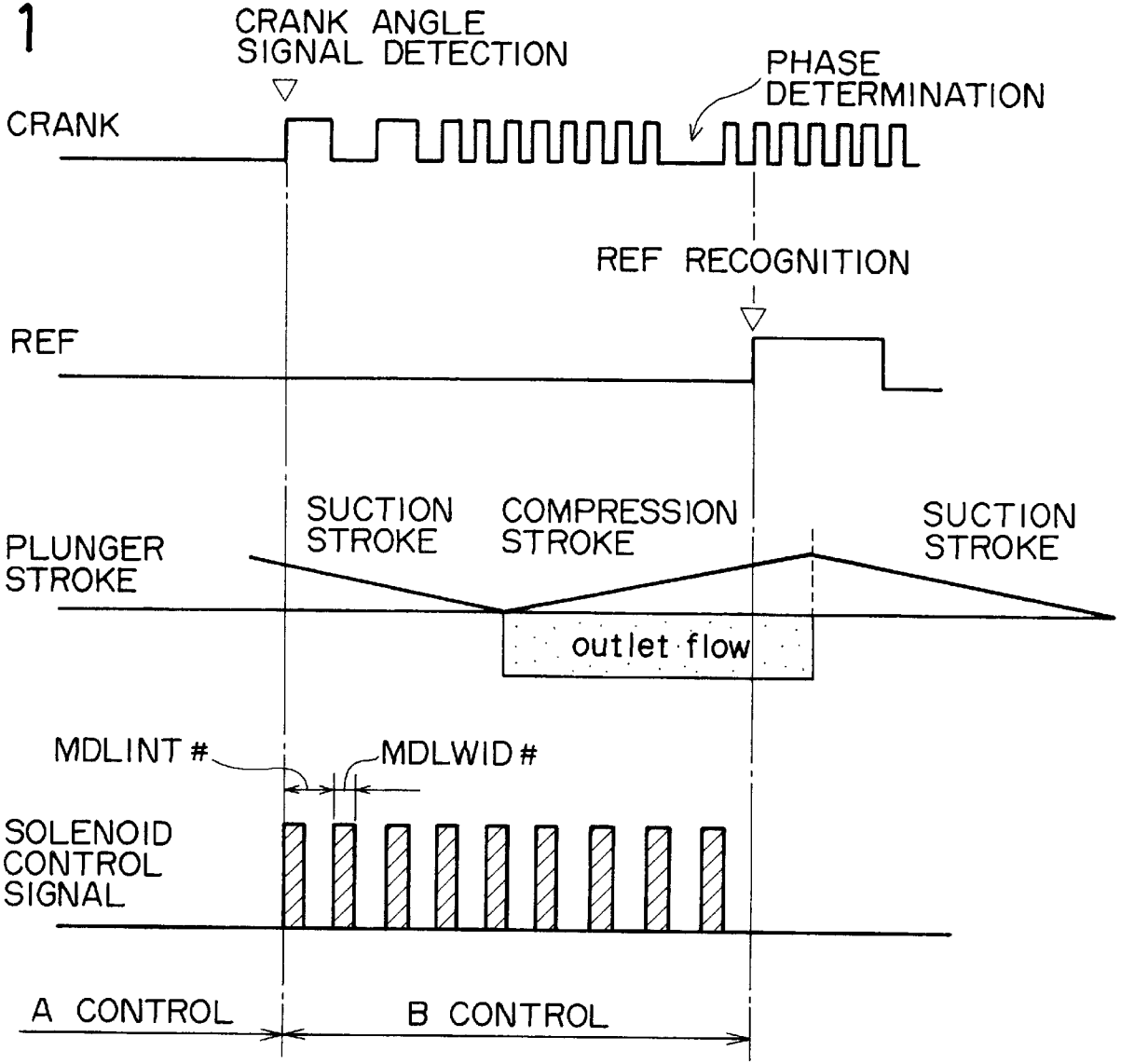
FIG. 11 is an operation timing chart of an A control block to a B control block employed in the high-pressure fuel pump control device and in-cylinder injection engine control device shown in FIG. 1.
Figure 12:
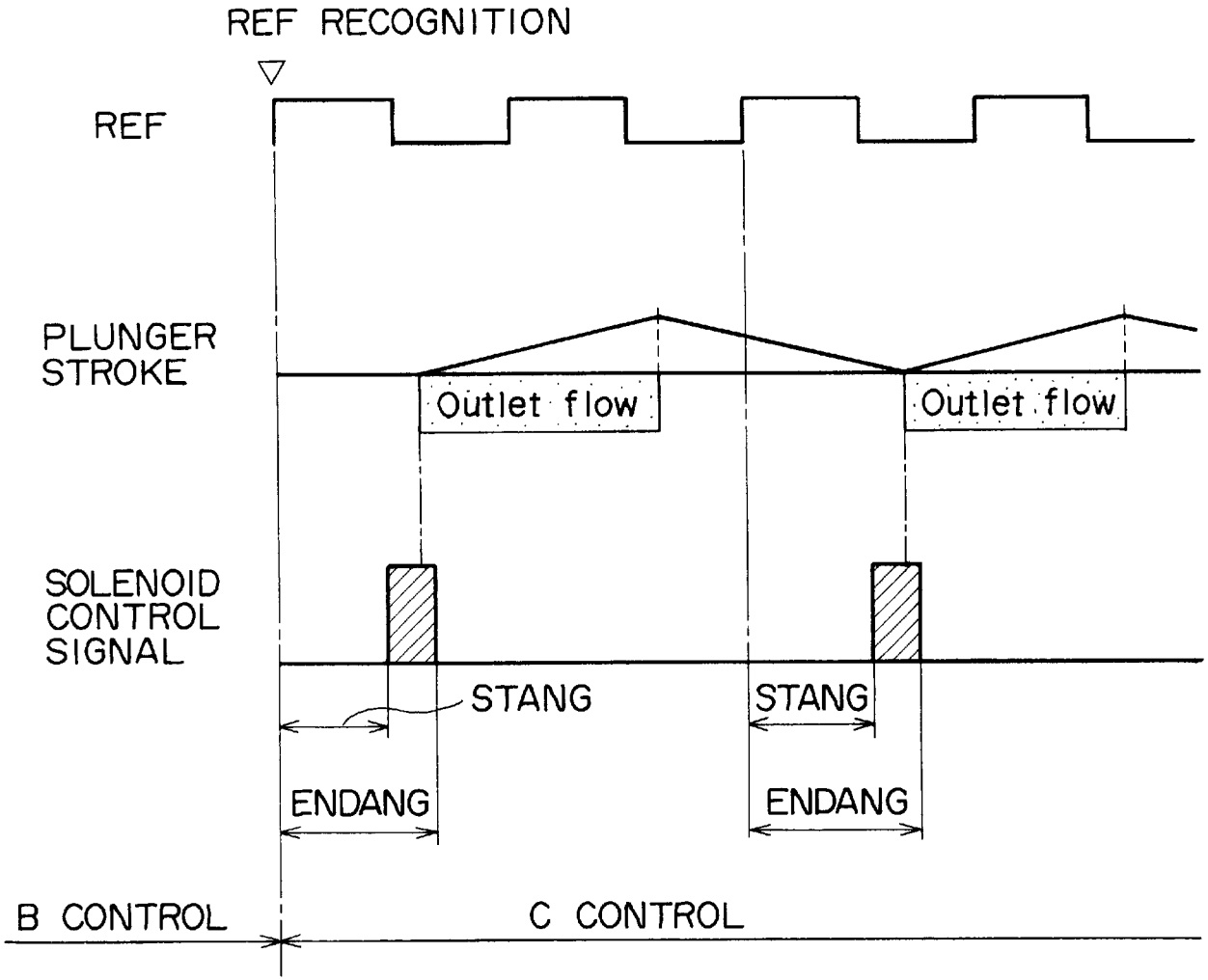
FIG. 12 is an operation timing chart of a B control block to a C control block employed in the high-pressure fuel pump control device and in-cylinder injection engine control device shown in FIG. 1.
Figure 13:
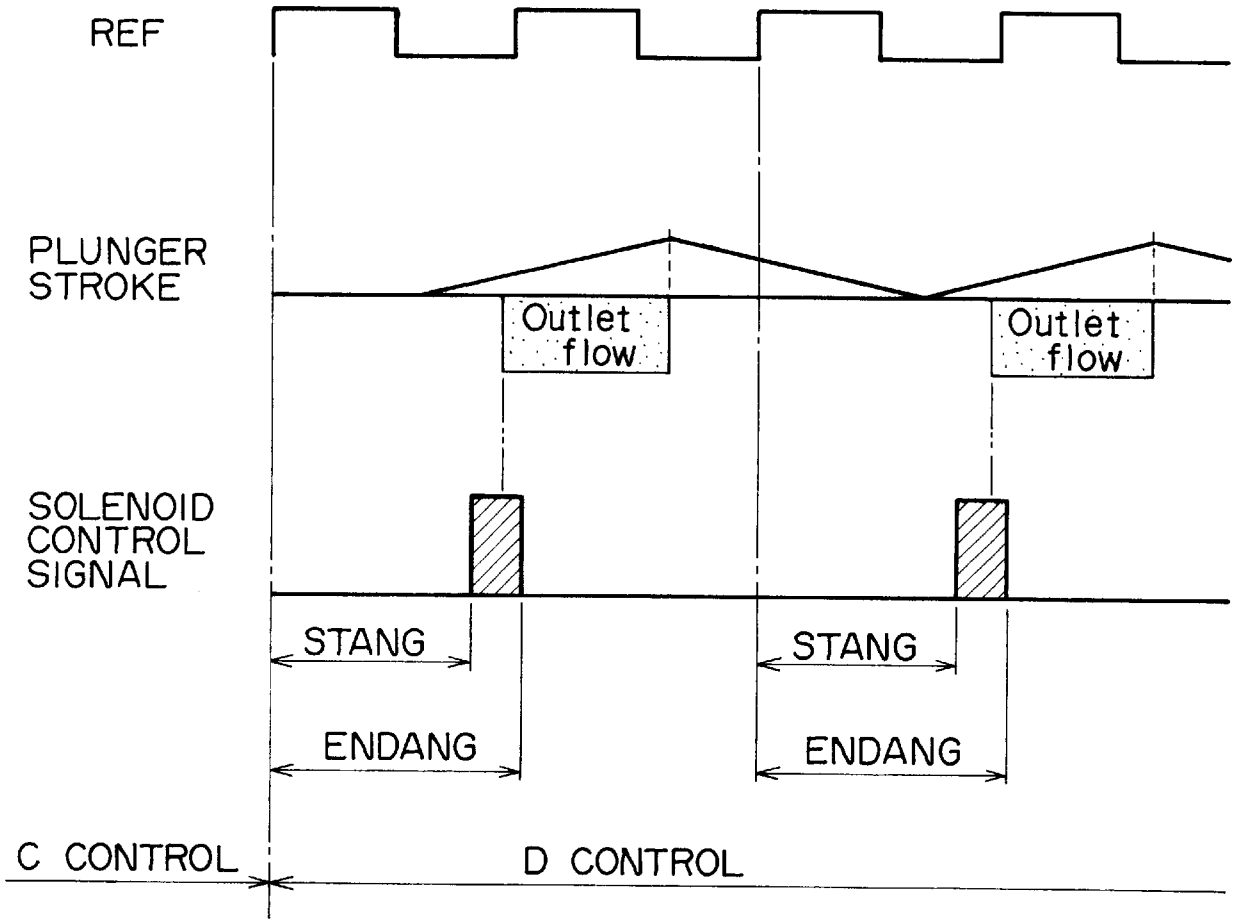
FIG. 13 is an operation timing chart of a C control block to a D control block employed in the high-pressure fuel pump control device and in-cylinder injection engine control device shown in FIG. 1.

FIGS. 11 through 13 are respectively timing charts for describing control of the high-pressure fuel pump 1 by the control unit 515. First of all, FIG. 11 is an operation timing chart of an A control block to a B control block in the control unit 515.

When the ignition switch is turned ON and the engine 507 starts cranking and the control unit 515 detects a first crank angle signal CRANK, the control unit 515 first transitions from the A control block indicative of the de-energization control state to the B control block indicative of the equal-interval energization control state. Thus, the B control block is one which performs equal-interval energization for outputting drive signals to the solenoid 200 of the high-pressure fuel pump 1 at least two times or more during a period in which the plunger 2 is reciprocated once, thereby repeating ON-OFF of a solenoid control signal in succession. This ON-OFF signal is set to an ON period of a predetermined angle (time) MDLWID# (e.g., 20 ms) in a predetermined cycle MDLINT# (e.g., 50 ms) in synchronism with the rising edge of a signal outputted from the crank angle sensor 516. Further, the ON-OFF signal is outputted until the REF signal can be generated and recognized, depending on whether the CAM signal is Hi or Lo when the CRANK signal is made absent or cut off.

Thus, the control unit 515 allows the force-feeding of the maximum delivery quantity of a high-pressure fuel to the common rail 53 regardless of the bottom dead center position of the plunger 2 until it detects a CRANK signal tooth-chipped portion and a CAM signal, i.e., even when the time at which the plunger 2 of the high-pressure fuel pump 1 reaches the bottom dead center position, cannot be recognized. Further, the control unit 515 aims to increase the fuel pressure of each injector 54 as practicable from the start-up of the engine. When the REF signal is recognized, the control unit 515 changes to a C control block.

FIG. 12 is an operation timing chart of the B control block to the C control block in the control unit 515.

When the control unit 515 recognizes the REF signal and determines the plunger phase as described above, the control unit 515 transitions from the B control block to the C control block corresponding to the full delivery control. At the predetermined output start angle STANG and the predetermined output end angle ENDANG as viewed from the recognition of the REF signal, the control unit 515 outputs such a solenoid control signal as to interpose the bottom dead center of the plunger 2. When an increase in the engine speed is recognized, the control unit 515 changes to the D control block.

FIG. 13 is an operation timing chart for describing control from the C control block by the control unit 515.

When an increase in the engine speed is recognized, the control unit 515 transitions from the C control block to the D control block corresponding to the fixed-phase control. In the D control block, the control unit 515 outputs such a solenoid control signal as to start fuel delivery in a predetermined time (for 200 ms, for example) subsequent to the complete detonation of the engine, based on the predetermined output start angle STANG and the predetermined output end angle ENDANG as viewed or taken from the recognition of the REF signal in order to improve the connection or relation between the full delivery control of the C control block and the F/B control block. When the predetermined time has elapsed after the complete detonation of the engine, the control unit 515 shifts to the F/B control block subsequently.

Figure 14:
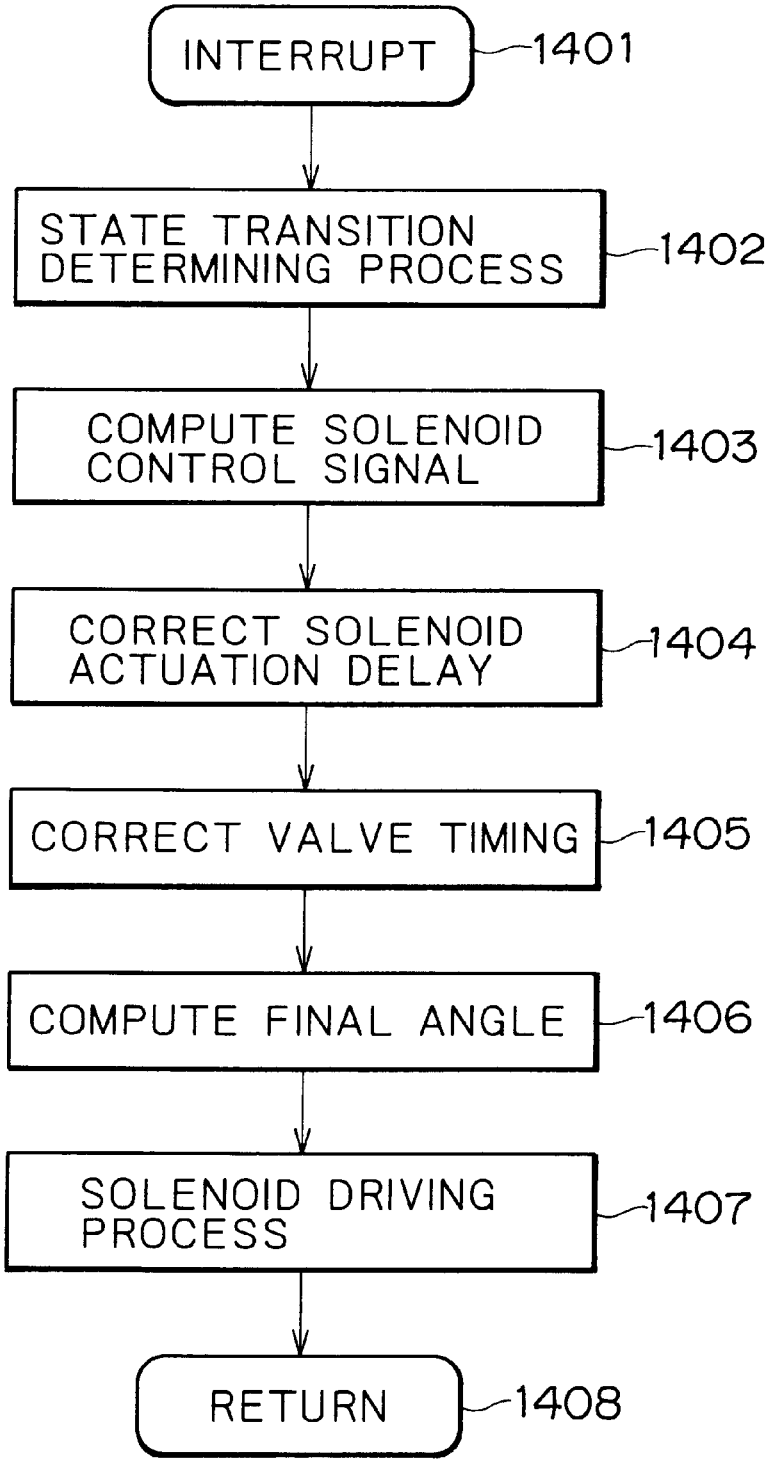
FIG. 14 is an operation flowchart of the high-pressure fuel pump control device and in-cylinder injection engine control device shown in FIG. 1.

FIGS. 14 through 20 are respectively flowcharts for describing control of the high-pressure fuel pump 1 by the control unit 515. Firstly, FIG. 14 is a flowchart showing the respective processes in FIG. 7.

In Step 1401, interrupt service or handling synchronized with the time like every 10 ms, for example, is executed. Incidentally, the interrupt handling may be one synchronized with the rotation like every crank angles 180°.

In Step 1402, the state transition determining means 710 performs a process for determining or making a decision as to state transition of the engine 507 to thereby decide to which state of the A control block to the F/B stop block the control unit 515 transitions. In Step 1403, the solenoid control signal computing means 714 computes a solenoid control signal according to the state determined by the state transition determining means 710. In Step 1404, the solenoid actuation delay correcting means 711 corrects a delay in the actuation of the solenoid 200. In Step 1405, the valve timing correcting means 712 performs a correction corresponding to variable valve timing.

Next, in Step 1406, a final angle is calculated based on the reference angle of the determined solenoid signal. In Step 1407, the solenoid driving means 713 outputs a drive pulse for the solenoid 200, based on the final angle.

Figure 15:
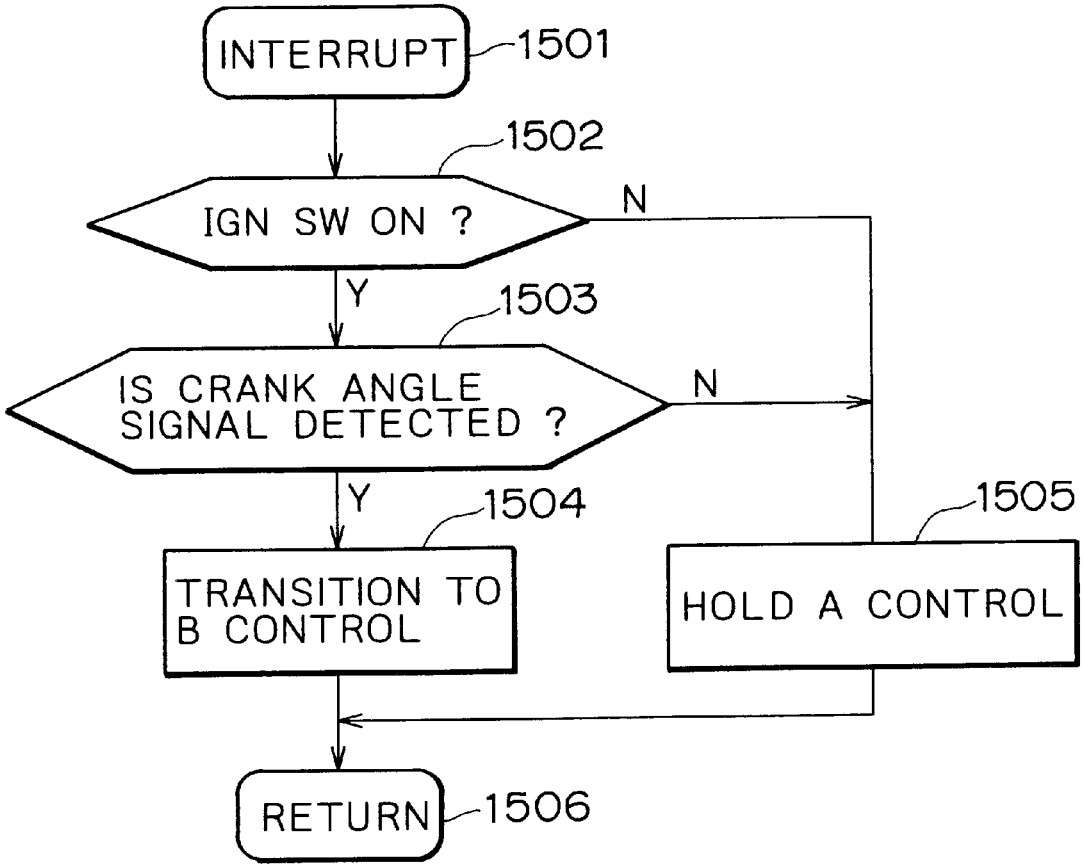
FIG. 15 is an operation flowchart of a state transition determining process for the A control block employed in the high-pressure fuel pump control device and in-cylinder injection engine control device shown in FIG. 1.

FIGS. 15 through 20 are respectively flowcharts for describing state transition determining processes of the engine 507 by the state transition determining means 710. FIG. 15 is a flowchart for describing a state transition determining process in the A control block of the control unit 515.

Step 1501 corresponds to interrupt service or handling similar to Step 1401 referred to above. It is determined in Step 1502 whether the ignition switch is ON. If the ignition switch is found to be ON, i.e., the answer is found to be YES, then the control unit 515 proceeds to Step 1503, where it is determined whether a crank angle signal CRANK has been detected. On the other hand, when the ignition switch is OFF, the control unit 515 proceeds to Step 1505 where the A control block is maintained. The control unit 515 proceeds to Step 1506 as an initial state without energization for the solenoid 200, where the present routine is ended.

When cranking is started and the first crank angle signal CRANK is detected in Step 1503, i.e., when the answer is found to be YES, the control unit 515 proceeds to Step 1504 where it transitions to the B control block. Further, the control unit 515 proceeds to Step 1506 where the present routine is completed. On the other hand, when the first crank angle signal CRANK is not detected, the control unit 515 proceeds to Step 1505 where the A control block is held.

Figure 16:
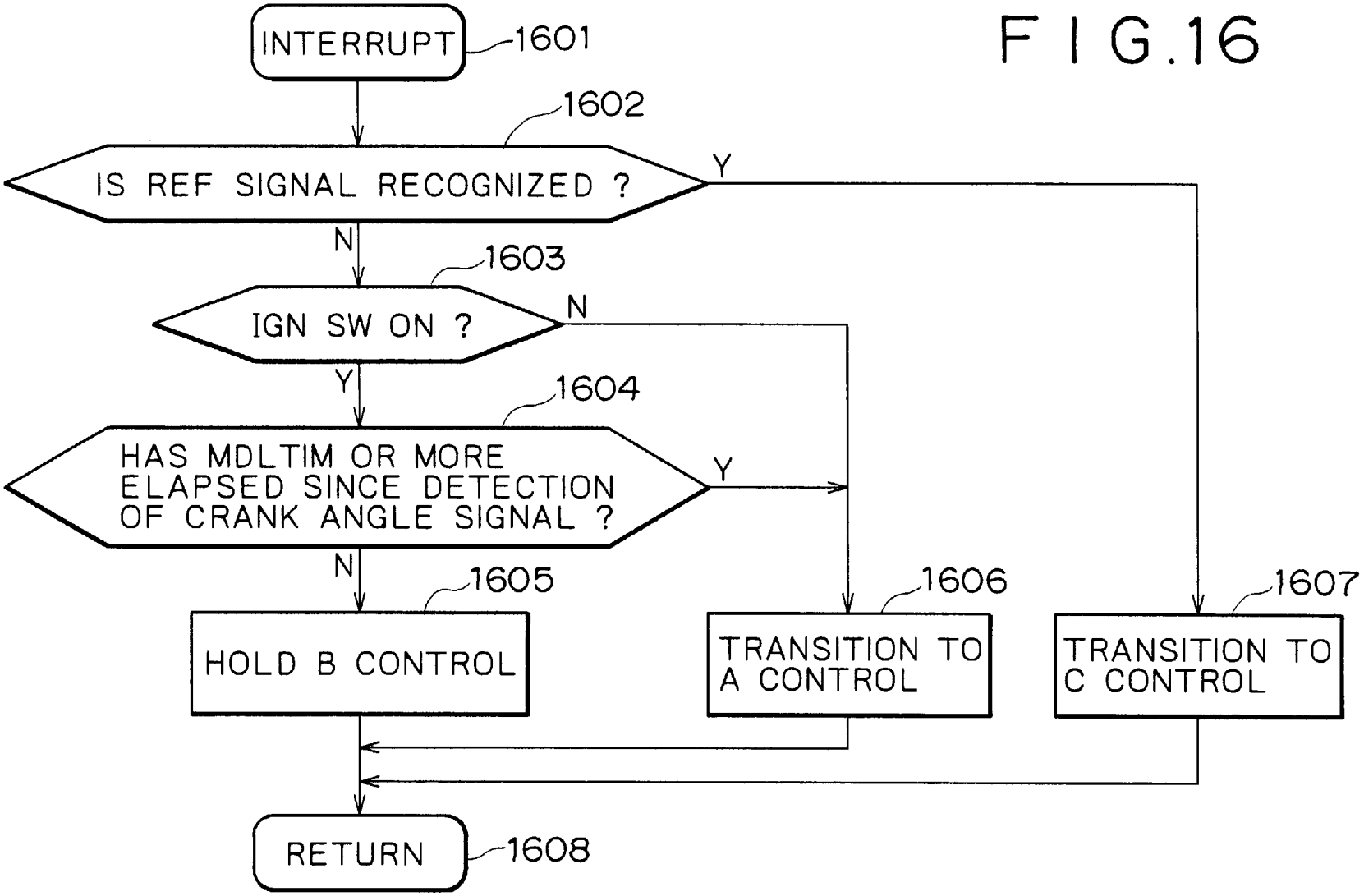
FIG. 16 is an operation flowchart of a state transition determining process for the B control block employed in the high-pressure;fuel pump control device and in-cylinder injection engine control device shown in FIG. 1.

FIG. 16 is a flowchart for describing a state transition determining process in the B control block of the control unit 515.

Step 1601 corresponds to interrupt service or handling similar to Step 1401 referred to above. It is determined in Step 1602 whether a REF signal has been recognized. When the REF signal is recognized, i.e., the answer is found to be YES, the control unit 515 proceeds to Step 1607 where it transitions to the C control block. Thereafter, the control unit 515 proceeds to Step 1608 where the present routine is terminated. On the other hand, when the REF signal is not recognized, the control unit 515 proceeds to Step 1603 where it is determined whether the ignition switch is ON. When the ignition switch is found to be ON, i.e., the answer is found to be YES, the control unit 515 proceeds to Step 1604. When the ignition switch is OFF, the control unit 515 proceeds to Step 1606 where it shifts to the A control block. The control unit 515 proceeds to Step 1608 without energization for the solenoid 200, where the present routine is finished.

It is determined in Step 1604 whether a predetermined time MDLTIM (e.g., 1 sec) or more has elapsed since the detection of the crank angle signal. When the predetermined time MDLTIM or more has elapsed, i.e., the answer is found to be YES, the control unit 515 proceeds to Step 1606 where it is returned to the A control block. When the predetermined time MDLTIM or more has not elapsed, the control unit 515 proceeds to Step 1605 where the B control block is held. Thereafter, the control unit 515 proceeds to Step 1608 where the present routine is completed.

Incidentally, as described above, the path from Step 1604 to Step 1606 is provided to prevent the battery from being dead due to the continuous execution of the B control block when the engine stalls in the course of cracking.

Figure 17:
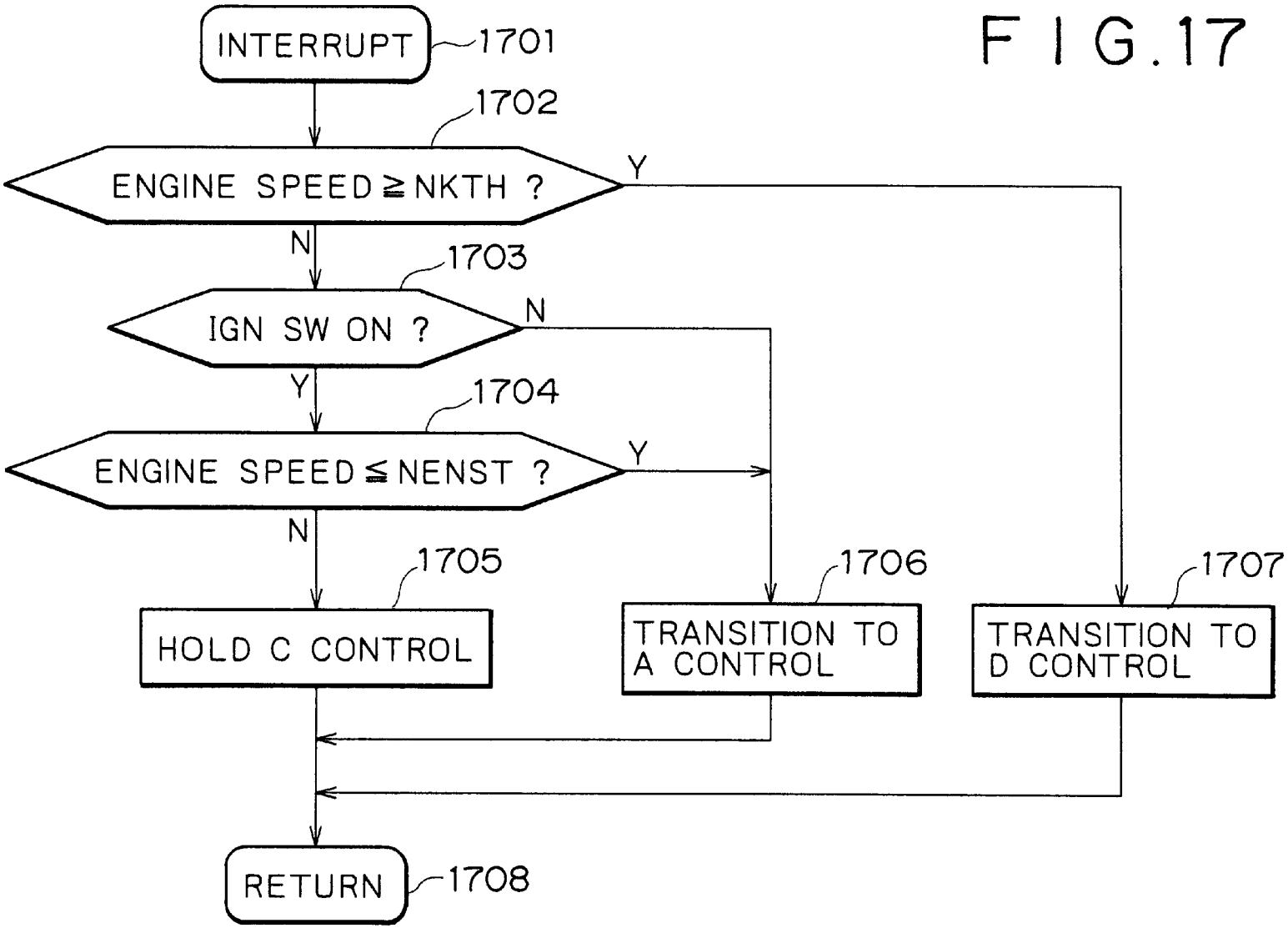
FIG. 17 is an operation flowchart of a state transition determining process for the C control block employed in the high-pressure fuel pump control device and in-cylinder injection engine control device shown in FIG. 1.

FIG. 17 is a flowchart for describing a state transition determining process in the C control block of the control unit 515.

Step 1701 corresponds to interrupt service or handling similar to Step 1401 referred to above. It is determined in Step 1702 whether the engine speed is greater than or equal to NKTH (e.g., 1000 rpm), i.e., the engine is completely detonated. When the engine speed is greater than or equal to the predetermined number of revolutions NKTH, i.e., the answer is found to be YES, the control unit 515 proceeds to Step 1707 where it transitions to the D control block. Thereafter, the control unit 515 proceeds to Step 1708 where the present routine is ended. On the other hand, when the engine speed is not greater than or equal to the predetermined number of revolutions NKTH, the control unit 515 proceeds to Step 1703 where it is judged whether the ignition switch is ON. When the ignition switch is found to be ON, i.e., the answer is found to be YES, the control unit 515 proceeds to Step 1704. When the ignition switch is OFF, the control unit 515 proceeds to Step 1706 where it jumps and shifts to the A control block. Thereafter, the control unit 515 proceeds to Step 1708 without energization for the solenoid 200, where the present routine is ended.

It is determined in Step 1704 whether the engine speed is less than or equal to a predetermined number of revolutions NENST (e.g., 200 rpm). When the engine speed is less than or equal to the predetermined number of revolutions NENST, i.e., the answer is found to be YES, the engine is judged to have stalled. Thereafter, the control unit 515 proceeds to Step 1706 where it jumps to the A control block to return thereto. When the engine speed is greater than or equal to the predetermined number of revolutions NENST, the control unit 515 proceeds to Step 1705 where it is held at the C control block. Thereafter, the control unit 515 proceeds to Step 1708 where the present routine is ended.

Figure 18:
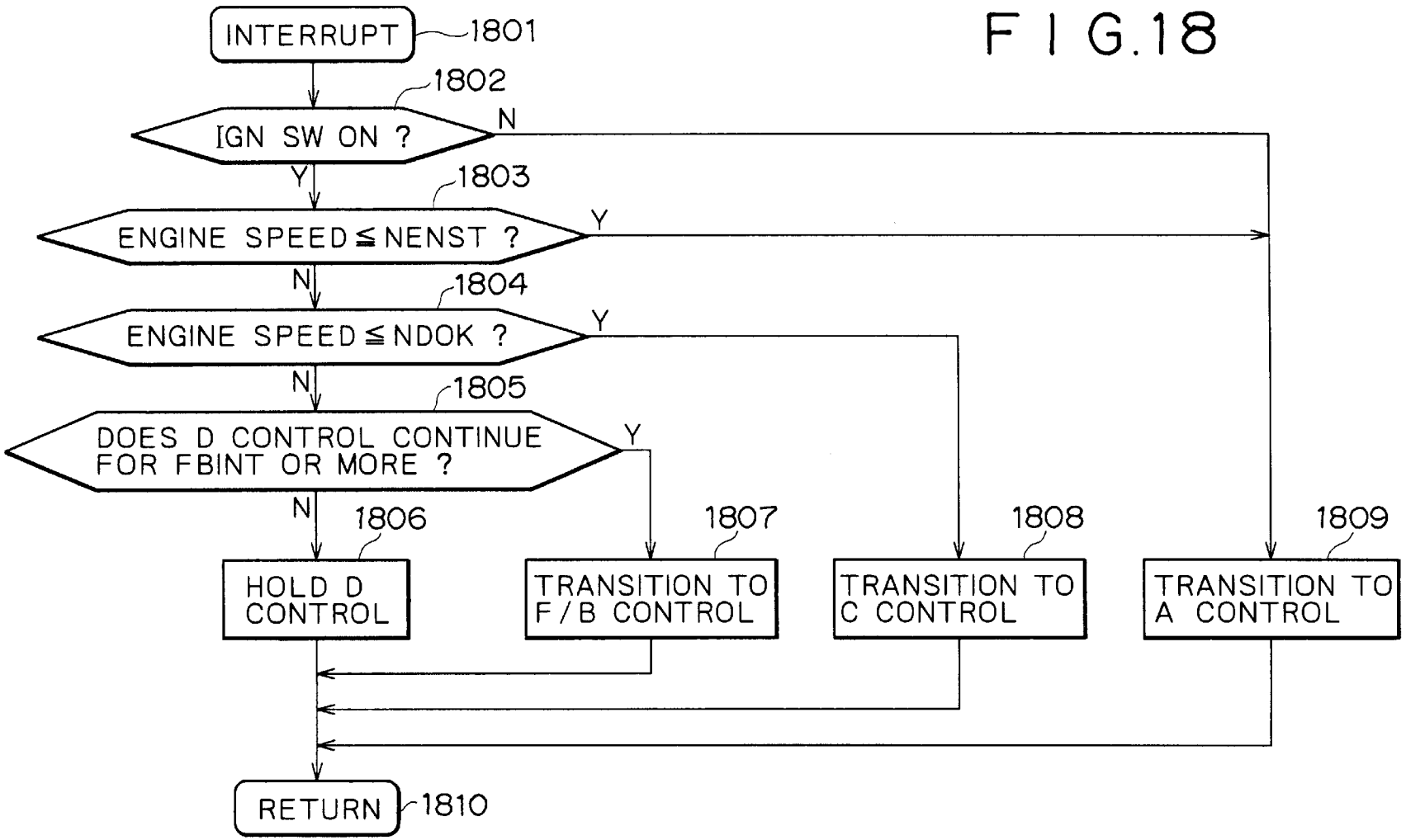
FIG. 18 is an operation flowchart of a state transition determining process for the D control block employed in the high-pressure fuel pump control device and in-cylinder injection engine control device shown in FIG. 1.

FIG. 18 is a flowchart for describing a state transition determining process in the D control block of the control unit 515.

Step 1801 corresponds to interrupt service or handling similar to Step 1401 referred to above. It is judged in Step 1802 whether the ignition switch is ON. When the ignition's witch is ON, i.e., the answer is found to be YES, the control unit 515 proceeds to Step 1803. When,the ignition switch is OFF, the control unit 515 proceeds to Step 1809 where it jumps to the A control block to shift thereto. Thereafter, the control unit 515 proceeds to Step 1810 without the execution of energization for the solenoid 200, where the present routine is ended. It is judged in Step 1803 whether the engine speed is less than or equal to a predetermined number of revolutions NENST (e.g., 200 rpm). When the engine speed is less than or equal to the predetermined number of revolutions NENST, i.e., the answer is found to be YES, it is judged that the engine has stalled. Thereafter, the control unit 515 jumps to the A control block to return thereto in Step 1809. On the other hand, when the engine speed is greater than or equal to the predetermined number of revolutions NENST, the control unit 515 proceeds to Step 1804 where it is determined whether the engine speed is less than or equal to a predetermined number of revolutions NDOK (e.g., 400 rpm). When the engine speed is less than or equal to the predetermined number of revolutions NDOK, i.e., the answer is found to be YES, the control unit 515 proceeds to Step 1808 where it transitions to the C control block. Afterwards, the control unit 515 proceeds to Step 1810 where the present routine is completed.

On the other hand, when the engine speed is greater than or equal to the predetermined number of revolutions NDOK in Step 1804, the control unit 515 proceeds to Step 1805 where it is determined whether the D control block continues for a predetermined time FBINT (e.g., 300 ms) or more. When it continues for the predetermined time FBINT or more, i.e., the answer is found to be YES, the control unit 515 proceeds to Step 1807 where it transitions to the F/B control block and proceeds to Step 1810 where the present routine is ended. When the D control block discontinues for the predetermined time FBINT or more, the control unit 515 proceeds to Step 1806 where it is held at the D control block. Thereafter, the control unit 515 proceeds to Step 1810 where the present routine is ended.

Figure 19:
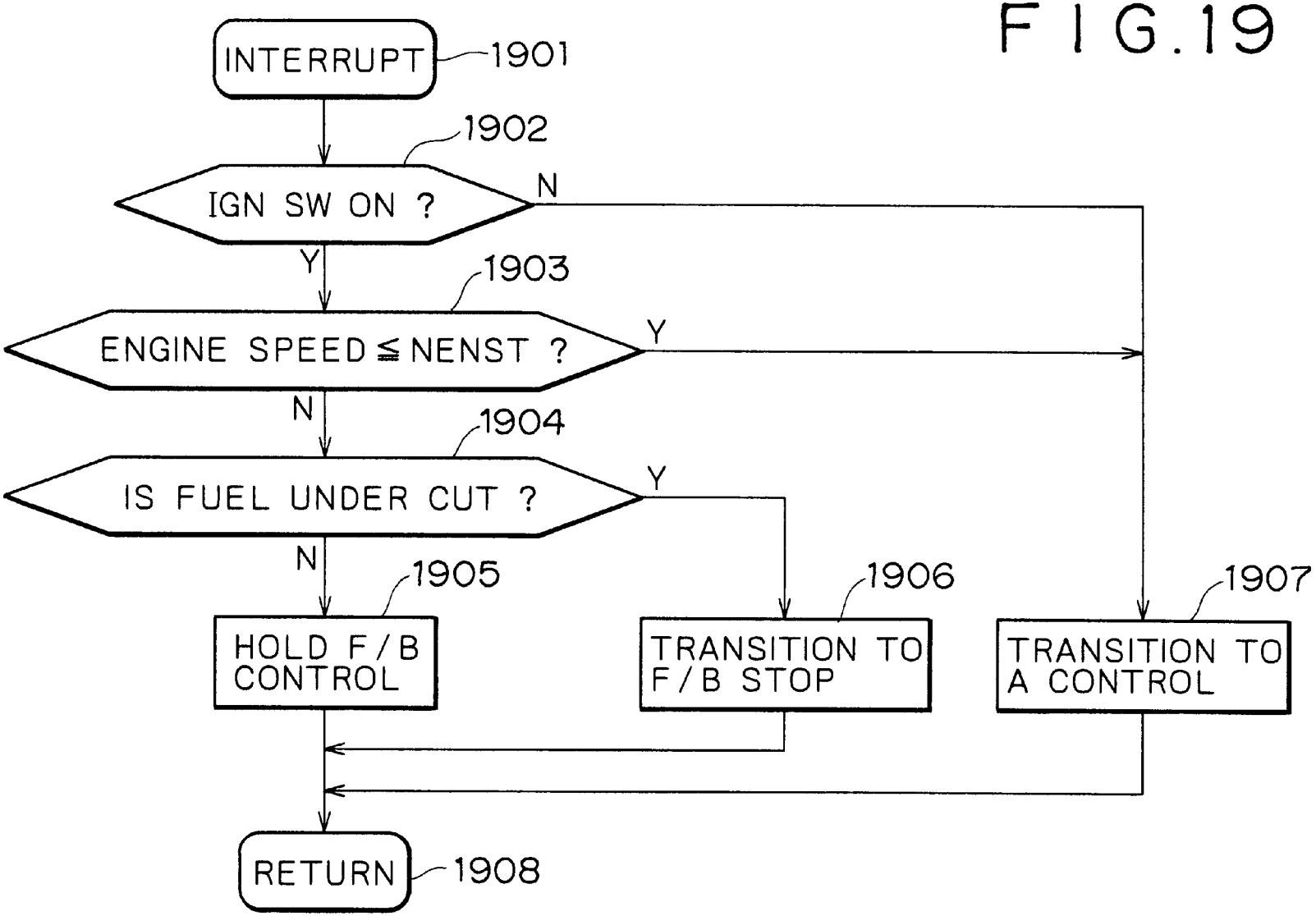
FIG. 19 is an operation flowchart of a state transition determining process for an F/B control block employed in the high-pressure fuel pump control device and in-cylinder injection engine control device shown in FIG. 1.

FIG. 19 is a flowchart for describing a state transition determining process in the F/B control block of the control unit 515.

Step 1901 corresponds to interrupt service or handing similar to Step 1401 referred to above. It is judged in Step 1902 whether the ignition switch is ON. When the ignition switch is ON, i.e., the answer is found to be YES, the control unit 515 proceeds to Step 1903. When the ignition switch is OFF, the control unit 515 proceeds to Step 1907 where it jumps to the A control block to shift thereto. Thereafter, the control unit 515 proceeds to Step 1908 without the execution of energization for the solenoid 200, where the present routine is ended.

It is determined in Step 1903 whether the engine speed is less than or equal to a predetermined number of revolutions NENST (e.g., 200 rpm). When the engine speed is less than the predetermined number of revolutions NENST, i.e., the answer is found to be YES, the engine is judged to have stalled, and the control unit 515 jumps to the A control block to return thereto in Step 1907. Thereafter, the control unit 515 proceeds to Step 1908 without the execution of energization for the solenoid 200, where the present routine is ended. On the other hand, when the engine speed is greater than or equal to the predetermined number of revolutions NENST, the control unit 515 proceeds to Step 1904.

It is determined in Step 1904 whether the fuel is being cut. When it is judged that the fuel is being cut, i.e., the answer is found to be YES, the control unit 515 proceeds to Step 1906 where it transitions to the F/B stop block. This is because when the fuel fed from the common rail 53 to each injector 54 is 0, the force-feeding of the fuel from the high-pressure fuel pump 1 is stopped to prevent a rise in the pressure of the common rail 53. Further, the control unit 515 proceeds to Step 1908 where the present routine is ended. On the other hand, when the fuel is not being cut, the control unit 515 proceeds to Step 1905 where it is held at the F/B control block. Thereafter, the control unit 515 proceeds to Step 1908 where the present routine is ended.

Figure 20:
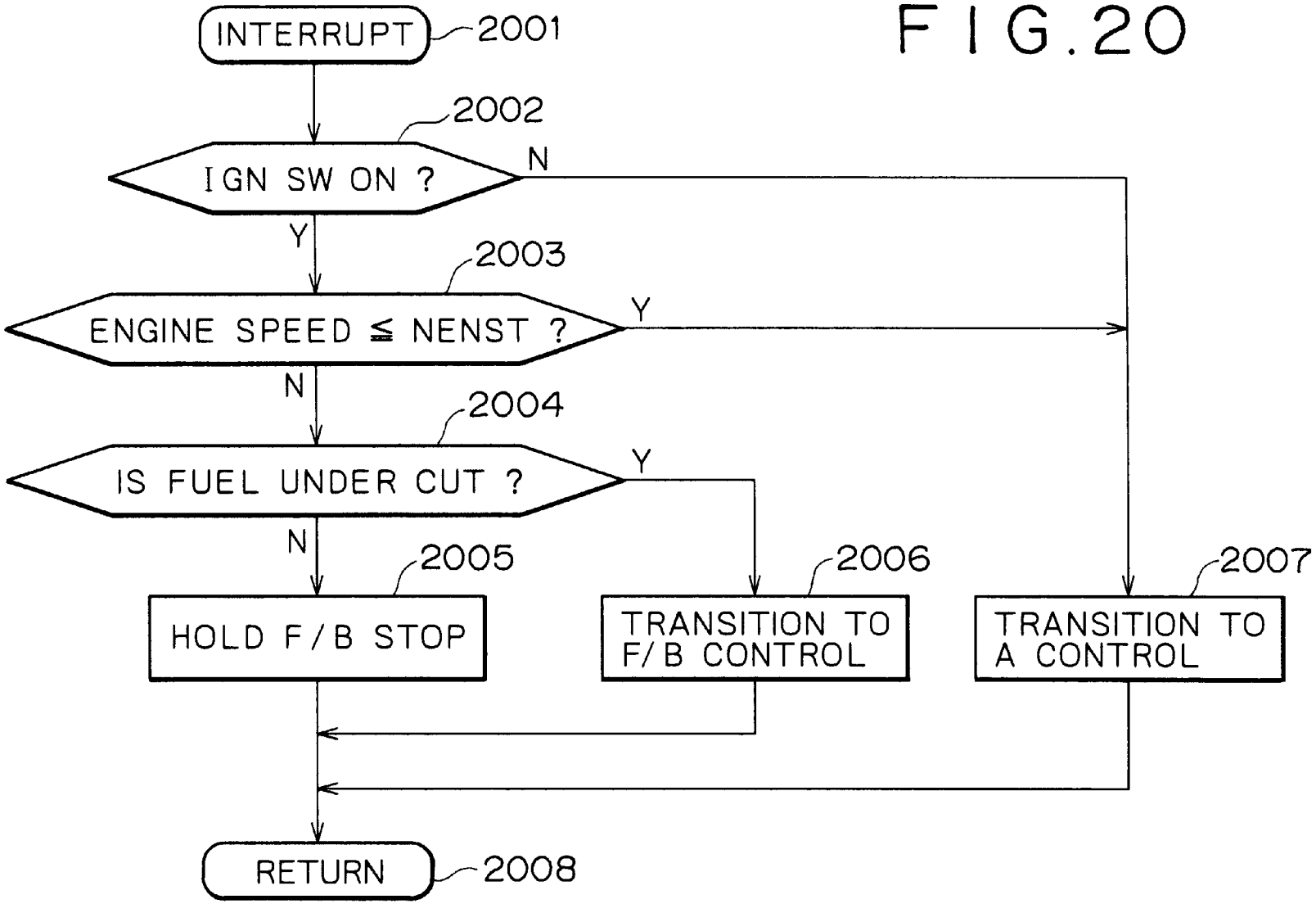
FIG. 20 is an operation flowchart of a state transition determining process for an F/B stop block employed in the high-pressure fuel pump control device and in-cylinder injection engine control device shown in FIG. 1.

FIG. 20 is a flowchart for describing a state transition determining process in the F/B stop block of the control unit 515.

Step 2001 corresponds to interrupt service or handing similar to Step 1401 referred to above. It is judged in Step 2002 whether the ignition switch is ON. When the ignition switch is ON, i.e., the answer is found to be YES, the control unit 515 proceeds to Step 2003. When the ignition switch is OFF, the control unit 515 proceeds to Step 2007 where it jumps to the A control block to shift thereto. Thereafter, the control unit 515 proceeds to Step 2008 without the execution of energization for the solenoid 200, where the present routine is ended.

It is determined in Step 2003 whether the engine speed is less than or equal to a predetermined number of revolutions NENST (e.g., 200 rpm). When the engine speed is less than the predetermined number of revolutions NENST, i.e., the answer is found to be YES, the engine is judged to have stalled, and the control unit 515 jumps to the A control block to return thereto in Step 2007. Thereafter, the control unit 515 proceeds to Step 2008 without the execution of energization for the solenoid 200, where the present routine is ended. On the other hand, when the engine speed is greater than or equal to the predetermined number of revolutions NENST, the control unit 515 proceeds to Step 2004.

It is determined in Step 2004 whether the fuel is being cut. When it is judged that the fuel is being cut, i.e., the answer is found to be YES, the control unit 515 proceeds to Step 2005 where it is held at the F/B stop block. Further, the control unit 515 proceeds to Step 2008 without the execution of energization for the solenoid 200, where the present routine is ended. On the other hand, when the fuel is not being cut, the control unit 515 proceeds to Step 2006 where it is caused to transition to the F/B control block. Thereafter, the control unit 515 proceeds to Step 2008 where the present routine is ended.

As described above, the above-described embodiment according to the present invention can bring about the following functions owing to the above construction.

The control unit 515 employed in the above-described embodiment controls the engine 507 having the injectors 54 included in the cylinders 507*b*, the high-pressure fuel pump 1 for force-feeding the fuel to the injectors 54, and the crank angle sensor 516 for detecting the position of the crankshaft 507*d*. The high-pressure fuel pump 1 includes the plunger 2 for pressurizing the fuel placed in the pump chamber 8, based on the solenoid signal, the pump drive cam 100 for driving the plunger 2, and the cam angle sensor 511 for detecting the position of the pump drive cam 100. The control unit 515 has the basic angle computing means 701 for computing the basic angle of the solenoid signal, based on the detected signals outputted from the crank angle sensor 516 and the fuel pressure sensor 56, the target fuel pressure calculating means 702 for calculating the target pressure, and the fuel pressure input processing means 703 for outputting the actual fuel pressure. Further, the control unit 515 is provided with the solenoid control signal computing means 714 for computing the reference angle of the solenoid signal, based on these respective means, the state transition determining means 710 for determining the state of the control unit 515 and causing it to transition, and the solenoid driving means 713 for driving the solenoid 200 of the high-pressure fuel pump 1. The solenoid control signal computing means 714 has the equal-interval energization control block 705 for giving the drive signals to the high-pressure fuel pump 1 at least two or more times from the time of signal detection of the crank angle sensor 516 to the time of determination of the phases of the crank angle sensor 516 and the cam angle sensor 511, the feedback control block 708 subsequent to the complete detonation or explosion of the control unit 515, etc. Since the six control blocks are transitioned by the state transition determining means 710, the fuel can reliably be delivered to the common rail 53 within one round or reciprocating stroke of the plunger 2 from the start-up of the engine 507 even in the case of the time at which recognition as to where the position of the plunger 2 exists is not obtained.

Figure 21:
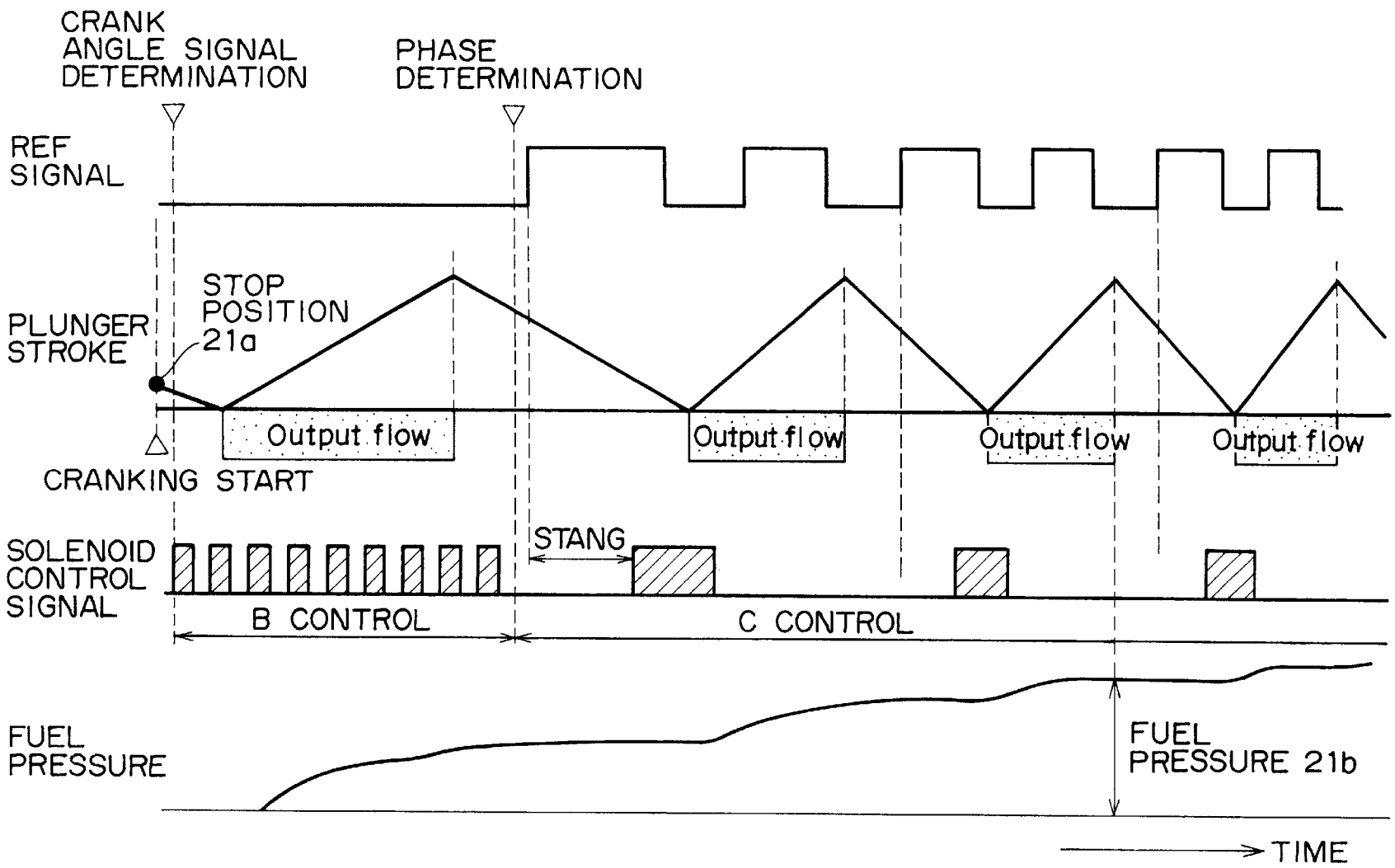
FIG. 21 is an operation timing chart at engine start-up based on the high-pressure fuel pump control device and in-cylinder injection engine control device shown in FIG. 1.

FIG. 21 is an operation timing chart at engine start-up based on the high-pressure pump 1 by the control unit. 515. When cranking is started from the start-up of an engine and a first crank angle signal is determined, the control unit 515 is transitioned to a B control block to perform equal-interval energization control, and hence each ON-OFF control signal for the solenoid 200 is repeatedly provided. Even when the time at which the plunger 2 reaches the bottom dead center, cannot be determined while the intake valve engagement member 201 is moved in the direction to close the intake valve 5 for each ON signal and the plunger 2 shifts to a compression stroke through the bottom dead center as viewed from a stop position 21*a* here, any ON signal in the neighborhood of the bottom dead center of the plunger 2 results in a trigger and hence the delivery of the fuel to the common rail 53 by the high-pressure fuel pump 1 is started. Thus, the force feeding of the fuel can be made fast by about one cycle as compared with the prior art, and the lengthening of an engine start-up time can be controlled.

Figure 22:
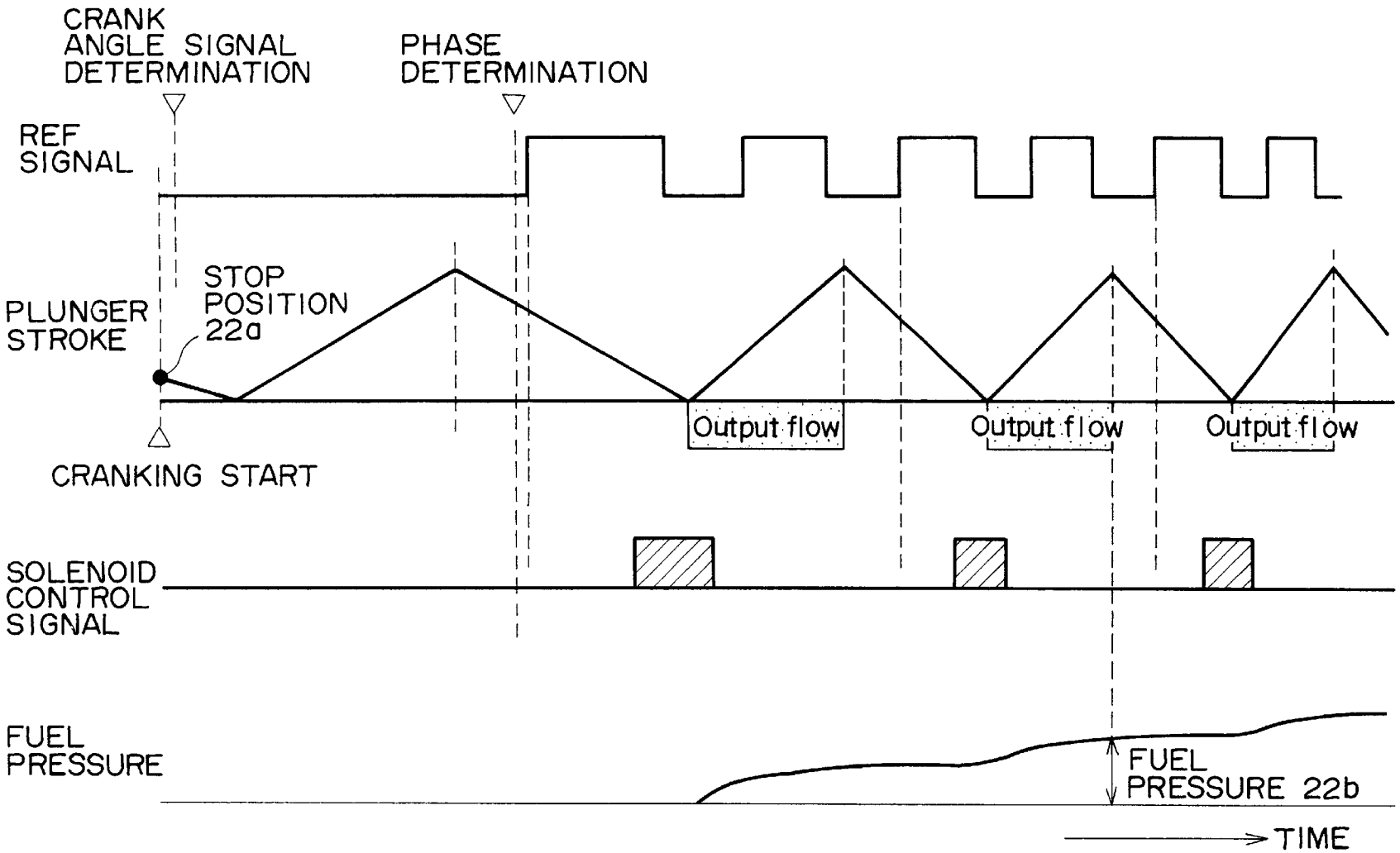
FIG. 22 is an operation timing chart at an engine start-up based on a conventional high-pressure fuel pump control device and in-cylinder injection engine control device.

Subsequently to the determination of a plunger phase, a solenoid control signal is outputted based on a REF signal according to the angle or time control. Fuel pressure 21*b* at the injection of the fuel by each injector 54 can be rendered higher than fuel pressure 22*b* (see FIG. 22) at conventional fuel injection. Thus, a rise in the fuel pressure can be promoted, the atomizing of an atomized particle size from each injector 54 can be promoted, and a reduction in the amount of exhaust of HC can also be achieved.

A detailed description has been made of the embodiment of the present invention as described above. However, the present invention is not limited to the embodiment. Various changes can be made to design without departing from the spirit of the present invention as defined in claims.

In the above-described embodiment, the high-pressure fuel pump 1 is placed on the cam shaft of the exhaust valve 526. However, the high-pressure fuel pump 1 may be placed on the cam shaft of the intake valve 514 or may be one synchronized with the crankshaft 507*d* of the cylinder 507*b*, for example. Even in this case, the detection signal switching means 715 and another drive signal setting means 717 can be applied to a signal break or the like, and the control of timing by the valve timing driving means can also be carried out.

The solenoid drive signal for the B control is subjected to equal-interval energization control for repeatedly outputting a drive signal having a predetermined width in a predetermined cycle upon engine start-up. However, even when the signals outputted from the crank angle sensor 516 and the cam angle sensor 511 or the like fall into a state unable to be absolutely detected due to a signal break or the like during, for example, the normal operation other than upon engine start-up, the equal-interval energization control can be applied thereto. Thus, the supply of the fuel to each injector 54 through the common rail 53 can be carried out and a vehicle can be shifted to a safe location to ensure driver's safety. Further, while the signal is synchronized with the rising edge of the signal outputted from the crank angle sensor 516, it may be one synchronized with the falling edge of the signal outputted from the crank angle sensor 516 or one synchronized with the rising edge and the falling edge. Furthermore, as the detection of the tooth-chipped portion of the signal outputted from the crank angle sensor 516, may be mentioned detection of another distinctive signal.

As is understood from the above description, the high-pressure fuel pump control device and in-cylinder injection engine control device according to the present invention can promote or accelerate fuel pressure from the start-up of an engine and achieve the shortening of an engine start-up time because equal-interval energization control for a high-pressure fuel pump is carried out since the detection of a crank angle signal.

Since fuel pressure at fuel injection is accelerated, a reduction in the amount of discharge of an exhaust gas substance, an increase in engine output, etc. can be achieved.

Further, failsafe can also be achieved by applying the equal-interval energization control to the high-pressure fuel pump upon the normal operation other than upon engine start-up.

What is claimed is:

1. A high-pressure fuel pump control device and an in-cylinder injection engine control device for controlling an in-cylinder injection engine, said in-cylinder injection engine including, a fuel injection valve provided in a cylinder;

a high-pressure fuel pump for force-feeding a fuel to said fuel injection valve; and a crank angle sensor for detecting the position of a crankshaft of the cylinder;

wherein said high-pressure fuel pump includes a plunger for pressurizing the fuel placed in said high-pressure fuel pump, a pump drive cam for driving the plunger, and a cam angle sensor for detecting the position of the pump drive cam; and said high-pressure fuel pump control device and in-cylinder injection engine control device include drive signal setting means for outputting drive signals to said high-pressure fuel pump at least two or more times from the time of signal detection of the crank angle sensor to the time of determination of phases of the crank angle sensor and the cam angle sensor.

2. The high-pressure fuel pump control device and in-cylinder injection engine control device as claimed in claim 1, wherein said drive signal setting means outputs the drive signal during the period in which said plunger is reciprocated once from the start-up of said in-cylinder injection engine.

3. The high-pressure fuel pump control device and in-cylinder injection engine control device as claimed in claim 1, which output each drive signal to said high-pressure fuel pump in synchronism with the rising edge or falling edge of a signal outputted from the crank angle sensor for detecting the position of the crankshaft in the cylinder or in synchronism with the rising edge and the falling edge thereof.

4. The high-pressure fuel pump control device and in-cylinder injection engine control device as claimed in claim 1, wherein said pump drive cam has a position detected by a signal outputted from a cam angle sensor for detecting the position of a cam shaft of an exhaust valve in the cylinder.

5. The high-pressure fuel pump control device and in-cylinder injection engine control device as claimed in claim 4, further including detection signal switching means for performing switching to the signal outputted from the cam angle sensor for detecting the position of a cam shaft of an intake valve in the cylinder or the signal outputted from the crank angle sensor for detecting the position of the crankshaft in the cylinder when the signal of the cam angle sensor for detecting the position of the cam shaft of the exhaust valve in the cylinder is undetectable.

6. The high-pressure fuel pump control device and in-cylinder injection engine control device as claimed in claim 1, wherein said pump drive cam has a position detected by the signal outputted from the cam angle sensor for detecting the position of the cam shaft of the intake valve in the cylinder.

7. The high-pressure fuel pump control device and in-cylinder injection engine control device as claimed in claim 6, further including detection signal switching means for performing switching to the signal outputted from the cam angle sensor for detecting the position of a cam shaft of an exhaust valve in the cylinder or the signal outputted from the crank angle sensor for detecting the position of the crankshaft in the cylinder when the signal of the cam angle sensor for detecting the position of the cam shaft of the intake valve in the cylinder is undetectable.

8. The high-pressure fuel pump control device and in-cylinder injection engine control device as claimed in claim 1, wherein said pump drive cam has a position detected by the signal outputted from the cam angle sensor for detecting the position of the crankshaft in the cylinder.

9. The high-pressure fuel pump control device and in-cylinder injection engine control device as claimed in claim 8, further including another drive signal setting means for repeatedly outputting drive signals each having a predetermined width to said high-pressure fuel pump in a predetermined cycle when the signal outputted from the crank angle sensor for detecting the position of the crankshaft in the cylinder is undetectable.

10. The high-pressure fuel pump control device and in-cylinder injection engine control device as claimed in claim 1, further including variable valve timing driving means for controlling timing provided to open or close the intake valve or exhaust valve in the cylinder, and wherein when the signal outputted from the cam angle sensor for detecting the position of the cam shaft of the intake valve or exhaust valve in the cylinder is undetectable, control of open/close timing by said variable valve timing driving means is stopped.

11. The high-pressure fuel pump control device and in-cylinder injection engine control device as claimed in claim 10, further including another drive signal setting means, for repeatedly outputting drive signals each having a predetermined width to said high-pressure fuel pump in a predetermined cycle when the control of the open/close timing by said variable valve timing driving means is discontinued.

12. The high-pressure fuel pump control device and in-cylinder injection engine control device as claimed in claim 11, wherein when the control of the open/close timing by said variable valve timing driving means is resumed, said another drive signal setting means is returned to said drive signal setting means.

13. The high-pressure fuel pump control device and in-cylinder injection engine control device as claimed in claim 1, wherein said high-pressure fuel pump comprises a pump chamber, a solenoid chamber and a cylinder chamber, and said pump chamber includes an intake valve provided on the solenoid chamber side and a valve closing spring urged in a direction to close the intake valve, and said solenoid chamber includes a solenoid, an intake valve engagement member brought into engagement with the intake valve, and a valve opening spring urged in a direction to open the intake valve.

14. A high-pressure fuel pump control device and an in-cylinder injection engine control device for controlling an,in-cylinder injection engine, said in-cylinder injection engine including, a fuel injection valve provided in a cylinder; and a high-pressure fuel pump for force-feeding a fuel to said fuel injection valve;

wherein said high-pressure fuel pump includes a plunger for pressurizing the fuel-placed in said high-pressure fuel pump, and a pump drive cam for driving the plunger; and said high-pressure fuel pump control device and in-cylinder injection engine control device include drive signal setting means for repeatedly outputting drive signals each having a determined width to said high-pressure fuel pump in a predetermined cycle during a period in which said plunger is reciprocated once.

15. A high-pressure fuel pump control device and in-cylinder injection engine control device for controlling an in-cylinder injection engine, said in-cylinder injection engine including, a fuel injection valve provided in a cylinder;

a high-pressure fuel pump for force-feeding a fuel to said fuel injection valve; and a crank angle sensor for detecting the position of a crankshaft in the cylinder;

wherein said high-pressure fuel pump includes a plunger for pressurizing the fuel placed in said high-pressure fuel pump, based on a solenoid signal, a pump drive cam for driving the plunger, and a cam angle sensor for detecting the position of the pump drive cam;

said high-pressure fuel pump control device and in-cylinder injection engine control device include basic angle computing means for computing a basic angle of the solenoid signal, based on detected signals outputted from said crank angle sensor and a fuel pressure sensor attached to said fuel injection valve, target fuel pressure calculating means for calculating target pressure, and fuel pressure input processing means for outputting actual fuel pressure, solenoid control signal computing means for computing a reference angle of the solenoid signal, based on these respective means, state transition determining means for determining the state of said in-cylinder injection engine and causing the same to transition, and solenoid driving means for driving a solenoid of the high-pressure fuel pump;

said solenoid control signal computing means includes an equal-interval energization control block for giving drive signals to said high-pressure fuel pump at least two or more times from the time of signal detection of said crank angle sensor to the time of determination of the phases of said crank angle sensor and said cam angle sensor, and a feedback control block subsequent to the complete explosion of said in-cylinder injection engine; and said respective control blocks are transitioned by said state transition determining means.

16. The high-pressure fuel pump control device and in-cylinder injection engine control device as claimed in claim 15, further including solenoid actuation delay correcting means for correcting a delay in actuation of the solenoid, based on the reference angle of the solenoid signal, which is calculated by said solenoid control signal computing means.

17. A high-pressure fuel pump control device for controlling an in-cylinder injection engine, said in-cylinder injection engine including, a fuel injection valve provided in a cylinder; and a high-pressure fuel pump for force-feeding a fuel to said fuel injection valve;

wherein said high-pressure fuel pump includes a plunger for pressurizing the fuel placed in said high-pressure fuel pump, a drive means for driving the plunger, and a sensor for detecting the position of the drive means; and said high-pressure fuel pump control device and in-cylinder injection engine control device include drive signal setting means for outputting drive signals to said high-pressure fuel pump at least two or more times before determination of said plunger position of high-pressure fuel pump based on said sensor signal.

* * * * *